US010522914B2

(12) United States Patent
Hong et al.

(10) Patent No.: US 10,522,914 B2
(45) Date of Patent: Dec. 31, 2019

(54) PATCH ANTENNA WITH FERRITE CORES

(71) Applicant: The Board of Trustees of the University of Alabama, Tuscaloosa, AL (US)

(72) Inventors: Yang-Ki Hong, Tuscaloosa, AL (US); Woncheol Lee, Tuscaloosa, AL (US)

(73) Assignee: The Board of Trustees of the University of Alabama, Tuscaloosa, AL (US)

( * ) Notice: Subject to any disclaimer, the term of this patent is extended or adjusted under 35 U.S.C. 154(b) by 144 days.

(21) Appl. No.: 15/392,692

(22) Filed: Dec. 28, 2016

(65) Prior Publication Data

US 2017/0187116 A1 Jun. 29, 2017

Related U.S. Application Data

(60) Provisional application No. 62/271,690, filed on Dec. 28, 2015.

(51) Int. Cl.
*H01Q 9/04* (2006.01)
*H01Q 1/38* (2006.01)

(52) U.S. Cl.
CPC ..... *H01Q 9/0407* (2013.01); *H01Q 1/38* (2013.01); *H01Q 9/0457* (2013.01)

(58) Field of Classification Search
CPC ..... H01Q 9/0407; H01Q 9/0457; H01Q 1/38
See application file for complete search history.

(56) References Cited

U.S. PATENT DOCUMENTS 6,611,180 B1 * 8/2003 Puzella ..... H01P 1/387 333/1.1
2004/0150577 A1 * 8/2004 Swoboda ..... B60R 25/24 343/788
2012/0119135 A1 * 5/2012 Ryou ..... C01G 49/0018 252/62.58
2014/0349520 A1 * 11/2014 Aizawa ..... H01R 13/6588 439/607.12
2015/0069134 A1 * 3/2015 Westrick ..... G06K 19/07783 235/492
2015/0244075 A1 * 8/2015 Platt ..... H01Q 1/38 343/792

OTHER PUBLICATIONS

Horii, et al., "Harmonic Control by Photonic Bandgap on Microstrip Patch Antenna", IEEE Microwave and Guided Wave Letters, vol. 9, 1999, 13-15.
Kwon, et al., "A harmonic suppression antenna for an active integrated antenna", IEEE Microw. Wirel. Compon. Lett., vol. 13, 2003, 54-56.

(Continued)

*Primary Examiner* — Hai V Tran
*Assistant Examiner* — Awat M Salih
(74) *Attorney, Agent, or Firm* — Meunier Carlin & Curfman LLC

(57) ABSTRACT

Disclosed herein is a method and system for using ferrite cores to suppress harmonic radiation with microstrip patch antennas. In certain embodiments, the ferrites cores exemplified herein significantly suppressed second and third harmonic radiation generated by RF components coupled to the microstrip patch antenna.

26 Claims, 19 Drawing Sheets

(56) References Cited

OTHER PUBLICATIONS

Lin, et al., "Harmonic control for an integrated microstrip antenna with loaded transmission line", Microw. Opt. Technol. Lett., vol. 44, 2005, 379-383.
Liu, et al., "Harmonic suppression with photonic bandgap and defected ground structure for a microstrip patch antenna", IEEE Microw. Wirel. Compon. Lett., vol. 15, 2005, 55-56.
Sung, et al., "An Improved Design of Microstrip Patch Antennas Using Photonic Bandgap Structure", IEEE Transactions on Antennas and Propagation, vol. 53, No. 5, 2005, 1799-1804.
Sung, et al., "Harmonics Reduction With Defected Ground Structure for a Microstrip Patch Antenna", IEEE Antennas and Wireless Propagation Letters, vol. 2, 2003, 111-113.
Yeo, et al., "Harmonic Suppression Characteristic of a CPW-Fed Circular Slot Antenna Using Single Slot on a Ground Conductor", Progress in Electromagnetics Research Letters, vol. 11, 2009, 11-19.
Lee et al., Low loss Co2Z (Ba3Co2Fe24O41)—glass composite for gigahertz antenna application, Journal of App. Phys. 109, 2011, 07E530.

* cited by examiner

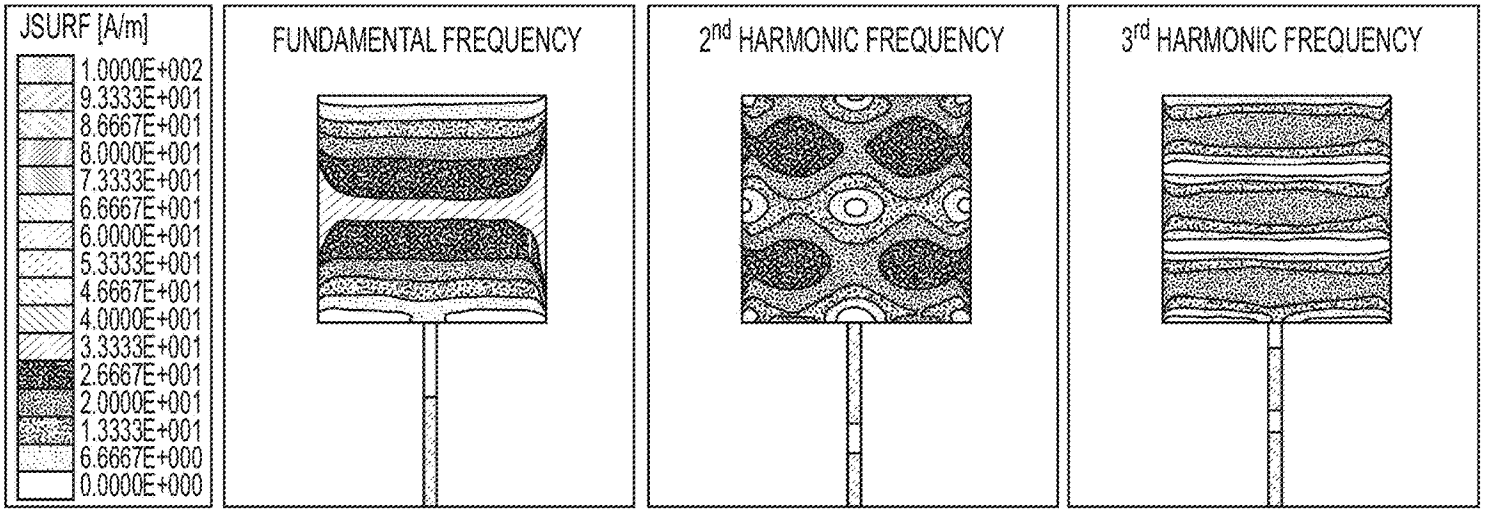
FIG. 23A
FIG. 23B
FIG. 23C
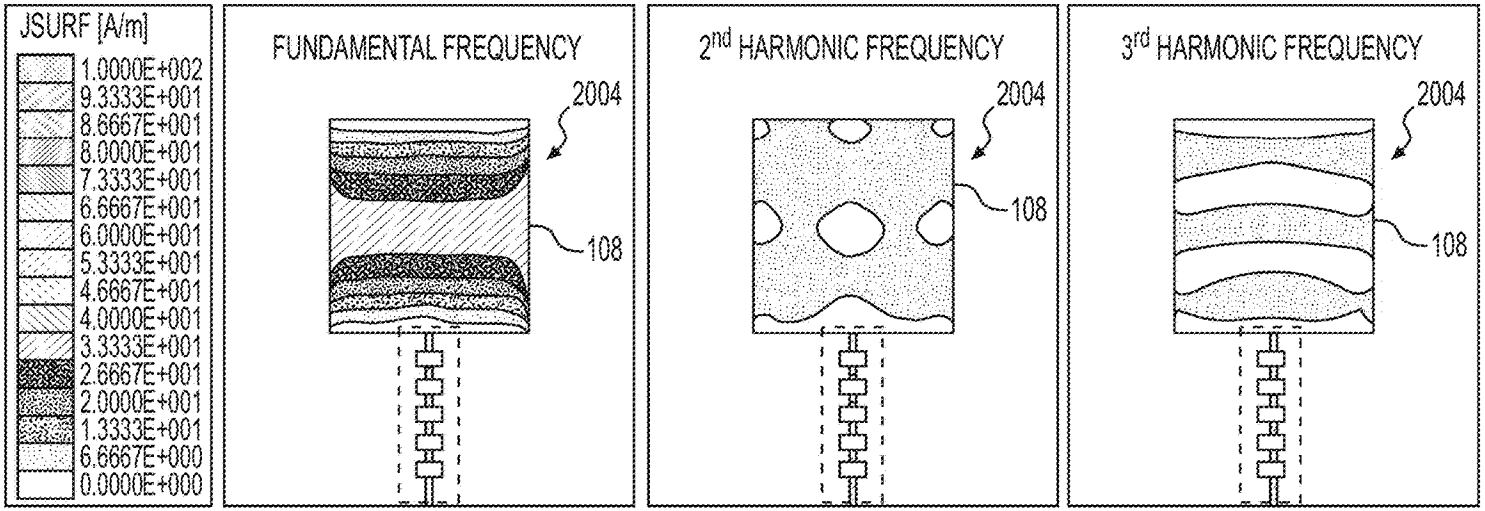
FIG. 24A
FIG. 24B
FIG. 24C

FABRICATED PATCH ANTENNAS
PA TOP

FABRICATED PATCH ANTENNAS
PA BOTTOM

FABRICATED PATCH ANTENNAS
MFC-PA

FABRICATED PATCH ANTENNAS
MFC-PA

PATCH ANTENNA WITH FERRITE CORES

RELATED APPLICATIONS

The present application claims priority to, and the benefit of, U.S. Prov. Appl. No. 62/271,690, filed Dec. 28, 2015, titled "Patch Antenna with Ferrite Cores," which is incorporated by reference herein in its entirety.

BACKGROUND

Microstrip patch antenna ("patch antenna") is widely used in wireless communication systems due to, for example, its low cost, high reliability, and compact size. Harmonic distortions produced by radio frequency (RF) devices in communication systems coupled to the patch antenna, including power amplifiers, may radiate through the antenna, causing degradation in the performance of the wireless communication system.

In current communication systems, to suppress the harmonic radiation, frequency filtering circuit, such as the band pass filter, may be incorporated into the system. In addition to increasing the size and cost of the communication system, the filter circuit are a source of insertion loss.

Several other approaches include using harmonic radiation suppressed antenna. It has been reported that photonic bandgap and defected ground structure suppressed harmonic frequencies, as well as usage of shorting pins and slots, may be used to shift the harmonic frequencies toward higher frequency than a fundamental frequency and removing the harmonic distortions at the higher frequency. However, these techniques have drawbacks including deformation of radiation pattern at the fundamental frequency and reduced antenna gain.

Therefore, what are needed are devices, systems and methods that overcome challenges in the present art, some of which are described above.

SUMMARY

Disclosed herein is a method and system for using ferrite cores to suppress harmonic radiation with microstrip patch antennas. In certain embodiments, the ferrites cores exemplified herein significantly suppressed second and third harmonic radiation generated by RF components coupled to the microstrip patch antenna.

In an aspect, a system comprising a patch antenna coupled to one or more ferrite cores is disclosed. The patch antenna includes a dielectric substrate having, on a first side, a radiator body in connection with a feedline and, on a second side, a reflector ground plane. The one or more ferrite cores include a first ferrite core coupled to the dielectric substrate proximal to the feedline.

In some embodiments, the system includes a circuit configured to generate a signal, said signal having one or more harmonic distortions from (e.g., radiation effects of) components of the circuit, wherein the one or more ferrite cores are configured to suppress at least one of the one or more harmonic distortions of the signals. In some embodiments the circuit includes a communication circuit (including one or more power devices) configured to generate a transmission signal (e.g., having a fundamental frequency at 16.25 MHz, 33.75 MHz, 900 MHz, 2.4 GHz, 4.9 GHz, 5.0 GHz, 5.9 GHz, 60 GHz), said transmission signal having harmonics distortions at a second and third harmonic frequencies from (e.g., radiation effects of) components of the communication circuit, wherein the one or more ferrite cores are configured to suppress (e.g., significantly suppress) harmonic distortions (e.g., greater than −15 dB or more) at the second and the third harmonic frequencies.

In some embodiments, the one or more ferrite cores, collectively, form an array of ferrite cores. In some embodiments, each of the one or more ferrite cores is evenly spaced from one another. In some embodiments, the array of one or more ferrite cores includes the first ferrite core, a second ferrite core, and a third core in which the first ferrite core and the second ferrite core are spaced at first distance, and the second ferrite core and the third ferrite core are spaced at a second distance, and in which the first distance is different from the second distance (e.g., such that the ferrites cores are unevenly spaced apart).

In some embodiments, each of the one or more ferrite cores of the array comprises the same material.

In some embodiments, the array of one or more ferrite cores include the first ferrite core and a second ferrite core in which the first ferrite core includes a first material, and the second ferrite core includes a second material, the first material being different from the second material.

In some embodiments, the array of one or more ferrite cores includes a second ferrite core having low permeability and magnetic loss characteristics, the second ferrite core being disposed proximal to the feedline.

In some embodiments, each of the one or more ferrite cores has permeability and a permittivity characteristics greater than unity.

In some embodiments, the array of one or more ferrite cores includes the first ferrite core and a second ferrite core in which the first ferrite core is proximally disposed, to the radiator body, at a first position along the feedline, and the second ferrite core is distally disposed, to the radiator body, at a second position along the feedline.

In some embodiments, the array of one or more ferrite cores includes the first ferrite core and a second ferrite core in which the first ferrite core is distally disposed, to the radiator body, at a first position along the feedline, and the second ferrite core is proximally disposed, to the radiator body, at a second position along the feedline.

In some embodiments, the first ferrite core has permeability and a permittivity characteristics greater than unity.

In some embodiments, the first ferrite core comprises spinel ferrite selected from the group consisting of a nickel-zinc (Ni—Zn) based ferrite composite, a manganese-zinc (Mn—Zn) based ferrite composite, a nickel-zinc-copper (Ni—Zn—Cu) based ferrite composite, a nickel-manganese-cobalt (Ni—Mn—Co) based ferrite composite, a cobalt (Co) based ferrite, lithium-zinc (Li—Zn) based ferrite composite, and a lithium-manganese (Li—Mn) based ferrite composite.

In some embodiments, the first ferrite core comprises hexagonal ferrite selected from the group consisting of an M-type hexaferrite, a Y-type hexaferrite, a Z-type hexaferrite, a W-type ferrite composite, an X-type hexaferrite, and U-type hexaferrite. In some embodiments, the first ferrite core comprises hexagonal ferrite selected from the group consisting of $Ba_3Co_2Fe_{24}O_{41}$, $BaCo_{1.4}Zn_{0.6}Fe_{16}O_{27}$, and $Ba_2Co_2Fe_{12}O_{22}$.

In some embodiments, the first ferrite core includes a first member and a second member in which the first member has a first surface and a second surface (e.g., opposing the first surface) and is disposed at the dielectric substrate such that the first surface is in contact with the reflector ground plane, and in which the second member is coupled to the second surface of the first member to form a continuous structure (e.g., to form a planar toroid).

In some embodiments, the first ferrite core includes a first member and a second member in which the first member has a first surface and is disposed at the reflector ground plane such that the first surface is in contact with the dielectric substrate, and in which the second member is coupled to the first surface of the first member to form a continuous structure (e.g., to form a planar toroid).

In some embodiments, the first ferrite core includes a first member and a second member, collectively, forming a continuous structure, in which the first member has a first cross-section profile selected from the group consisting of a U-shape profile, a planar profile, and an L-shape profile, and in which the second member has a second cross-section profile corresponding to the first cross-section profile so as to form a planar toroid body therewith.

In some embodiments, the first ferrite core includes a single unitary structure selected from the group consisting of a pot core, a U-shaped core, an E-shaped core, and a combination thereof.

In some embodiments, the first ferrite core is embedded in the dielectric substrate.

In some embodiments, the first ferrite core has a first thickness, and the dielectric substrate has a second thickness, the first thickness being the same with the second thickness.

In some embodiments, the first ferrite core has a first thickness, and the dielectric substrate has a second thickness, the first thickness being different from the second thickness.

In some embodiments, the first ferrite core encompasses the feedline.

In some embodiments, the first ferrite core partially encompasses (e.g., surrounds at three sides or less) of the feedline.

In some embodiments, the feedline of the patch antenna has a serpentine portion proximal to the first ferrite core.

In another aspect, an antenna apparatus is disclosed. The apparatus includes a dielectric substrate having, on a first side, a radiator body in connection with a feedline and, on a second side, a reflector ground plane; and one or more ferrite cores, including a first ferrite core, coupled to the dielectric substrate proximal to the feedline.

In another aspect, a method of using a harmonic radiation suppressed antenna with ferrite cores is disclosed. The method includes providing an electric circuit (e.g., a communication circuit) coupled to a first end of a feedline of a patch antenna, the patch antenna having one or more ferrite cores proximal to the feedline at a respective distance from the radiator body; and energizing the electric circuit to generate a RF electrical signal that flows through the feedline to a radiator body of the patch antenna, wherein the RF electrical signal has one or more harmonic distortions, including those at a second and third harmonic frequencies, suppressed at the feedline by the one or more ferrite cores disposed thereat.

BRIEF DESCRIPTION OF THE DRAWINGS

The components in the drawings are not necessarily to scale relative to each other and like reference numerals designate corresponding parts throughout the several views:

FIGS. 23*a*, 23*b*, 23*c*, 24*a*, 24*b*, and 24*c* respectively show simulated surface current distribution at the fundamental frequency, the second harmonic frequency, and the third harmonic frequency for an exemplary patch antenna configured with and without ferrite cores.

DETAILED DESCRIPTION

Unless defined otherwise, all technical and scientific terms used herein have the same meaning as commonly understood by one of ordinary skill in the art. Methods and materials similar or equivalent to those described herein can be used in the practice or testing of the present disclosure.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the Examples included therein and to the Figures and their previous and following description.

Figure 1:
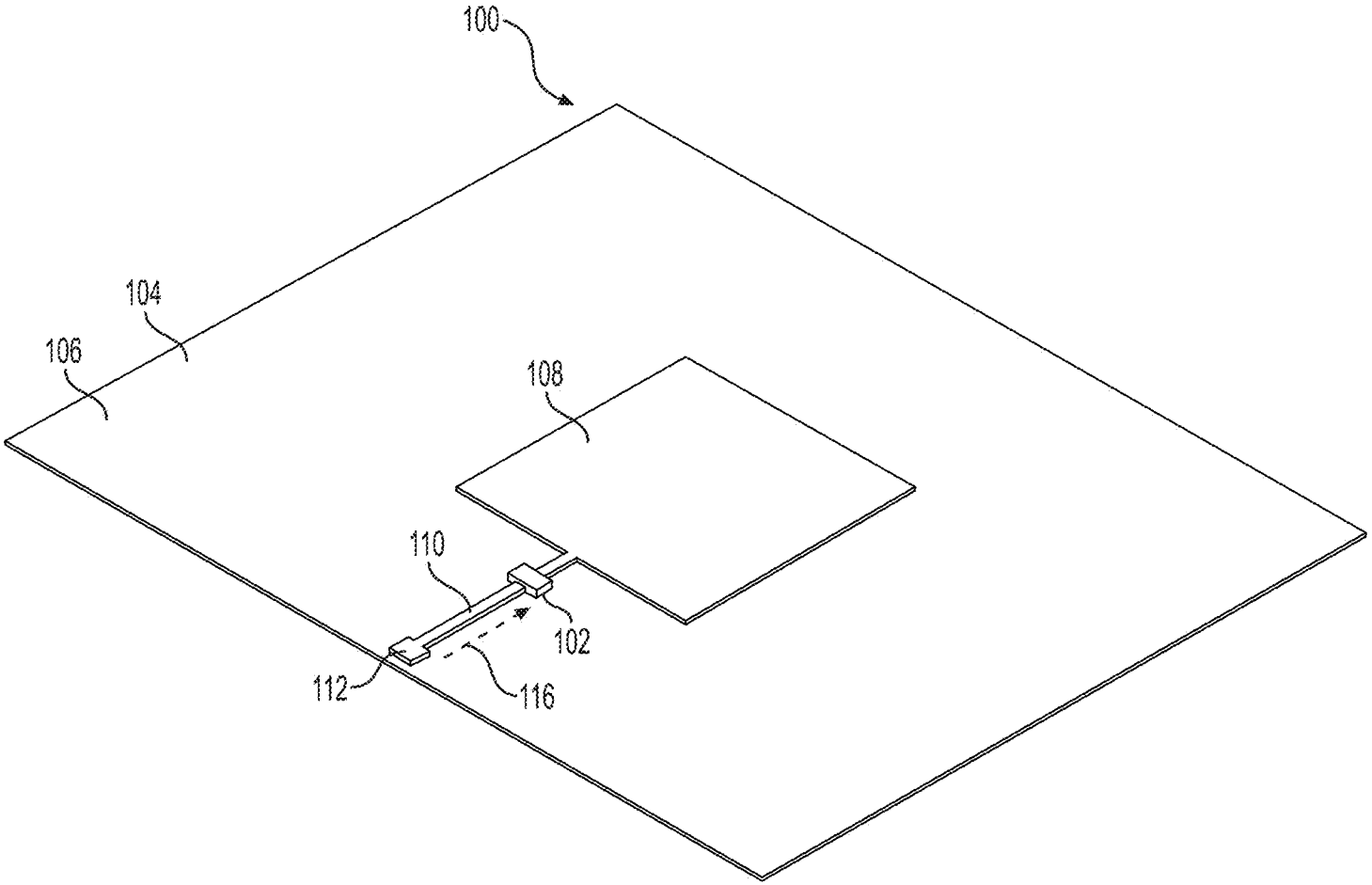
FIG. 1 depicts a diagram of an exemplary microstrip patch antenna coupled with one or more ferrite cores in accordance with an illustrative embodiment.

FIG. 1 depicts a diagram of a microstrip patch antenna 100 coupled with one or more ferrite cores 102 in accordance with an illustrative embodiment. The microstrip patch antenna 100 includes a dielectric substrate 104 (not shown—see FIG. 5) having, on a first side 106, a radiator body 108 in connection with a feedline 110 and, on a second side 112 (not shown—see FIG. 6), a reflector ground plane 114 (not shown—see FIG. 5). The feedline 110 terminates at a pad 112.

As shown, the microstrip patch antenna 100 includes one or more ferrite cores 102, including a first ferrite core 102*a* coupled to the dielectric substrate 104 proximal to the feedline 110. The ferrite cores 102 beneficially suppress radiation at harmonic frequencies from signals 116 received at the microstrip patch antenna 100 and reduces back lobe in the radiation pattern generated by the radiator body 108.

The ferrite core 102, in some embodiments, encompasses the feedline 110. In other embodiments, the ferrite core 102 is disposed proximal to, or partially encompasses, the feedline 110 such that the magnetic field of the ferrite core 102 is directed onto the feedline.

Figure 2:
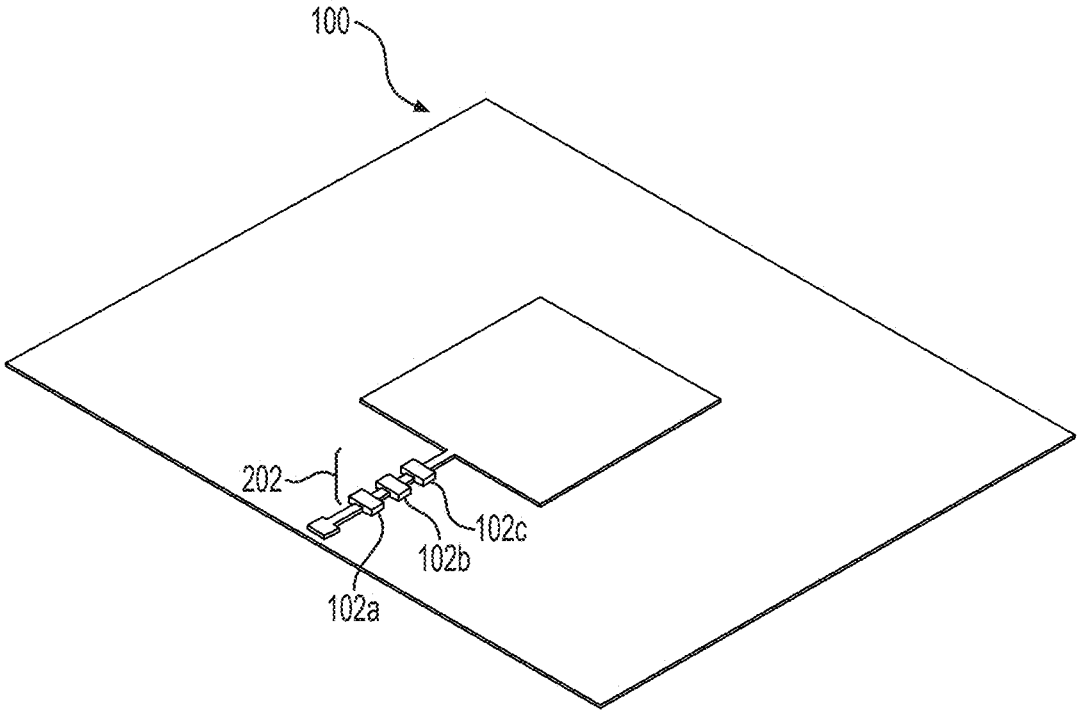
FIG. 2 depicts a diagram of an exemplary microstrip patch antenna coupled with an array of one or more ferrite cores in accordance with an illustrative embodiment.
Figure 3:
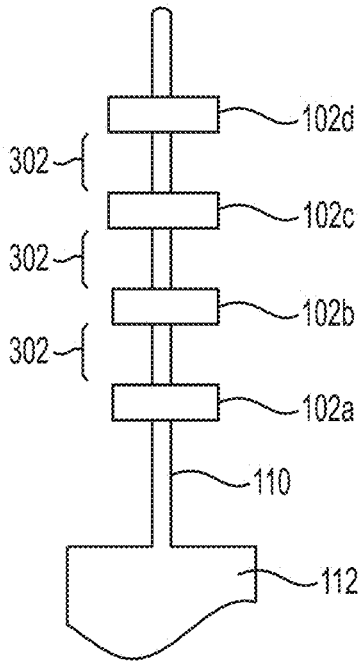
FIGS. 3 and 4 depict diagrams, each illustrating a configuration of the array of FIG. 2 in accordance to an illustrative embodiment.
Figure 4:
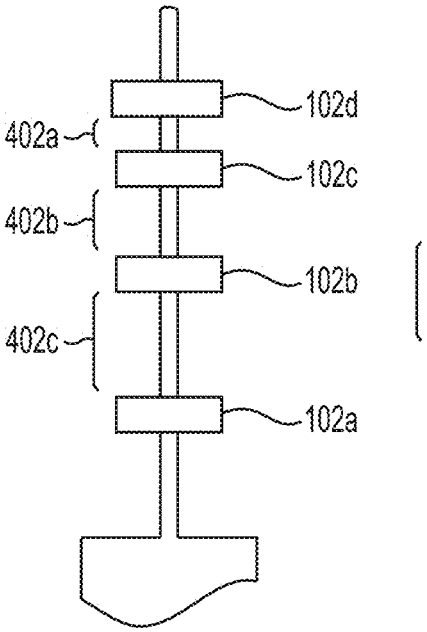

FIG. 2 depicts a diagram of an exemplary microstrip patch antenna 100 coupled with an array 202 of one or more ferrite cores 102 (shown as cores 102*a*, 102*b*, 102*c*, and 102*d*) in accordance with an illustrative embodiment. FIGS. 3 and 4 depict diagrams, each illustrating a configuration of the array 202 of FIG. 2 in accordance to an illustrative embodiment.

In some embodiments, the one or more ferrite cores collectively, form the array of ferrite cores. In some embodiments, each of the one or more ferrite cores is evenly spaced from one another. In some embodiments, the array of one or more ferrite cores includes the first ferrite core, a second ferrite core, and a third core in which the first ferrite core and the second ferrite core are spaced at first distance, and the second ferrite core and the third ferrite core are spaced at a second distance, and in which the first distance is different from the second distance (e.g., such that the ferrites cores are unevenly spaced apart).

In some embodiments, each of the one or more ferrite cores of the array comprises the same material. In other embodiments, the array of one or more ferrite cores include the first ferrite core and a second ferrite core in which the first ferrite core includes a first material, and the second ferrite core includes a second material, the first material being different from the second material.

In some embodiments, the array of one or more ferrite cores includes a second ferrite core having low permeability and magnetic loss characteristics, the second ferrite core being disposed proximal to the feedline.

In some embodiments, each of the one or more ferrite cores has permeability and a permittivity characteristics greater than unity.

In some embodiments, the array of one or more ferrite cores includes the first ferrite core and a second ferrite core in which the first ferrite core is proximally disposed, to the radiator body, at a first position along the feedline, and the second ferrite core is distally disposed, to the radiator body, at a second position along the feedline.

In some embodiments, the array of one or more ferrite cores includes the first ferrite core and a second ferrite core in which the first ferrite core is distally disposed, to the radiator body, at a first position along the feedline, and the second ferrite core is proximally disposed, to the radiator body, at a second position along the feedline.

In some embodiments, the first ferrite core has permeability and a permittivity characteristics greater than unity.

Referring to FIG. 3, each of the one or more ferrite cores 102*a*, 102*b*, 102*c*, and 102*d* is evenly spaced 302 from one another. In FIG. 4, the ferrites cores 102*a*, 102*b*, 102*c*, and 102*d* are spaced at different distances (shown as distance 402*a*, 402*b*, and 402*c*) from each other.

Figure 5:
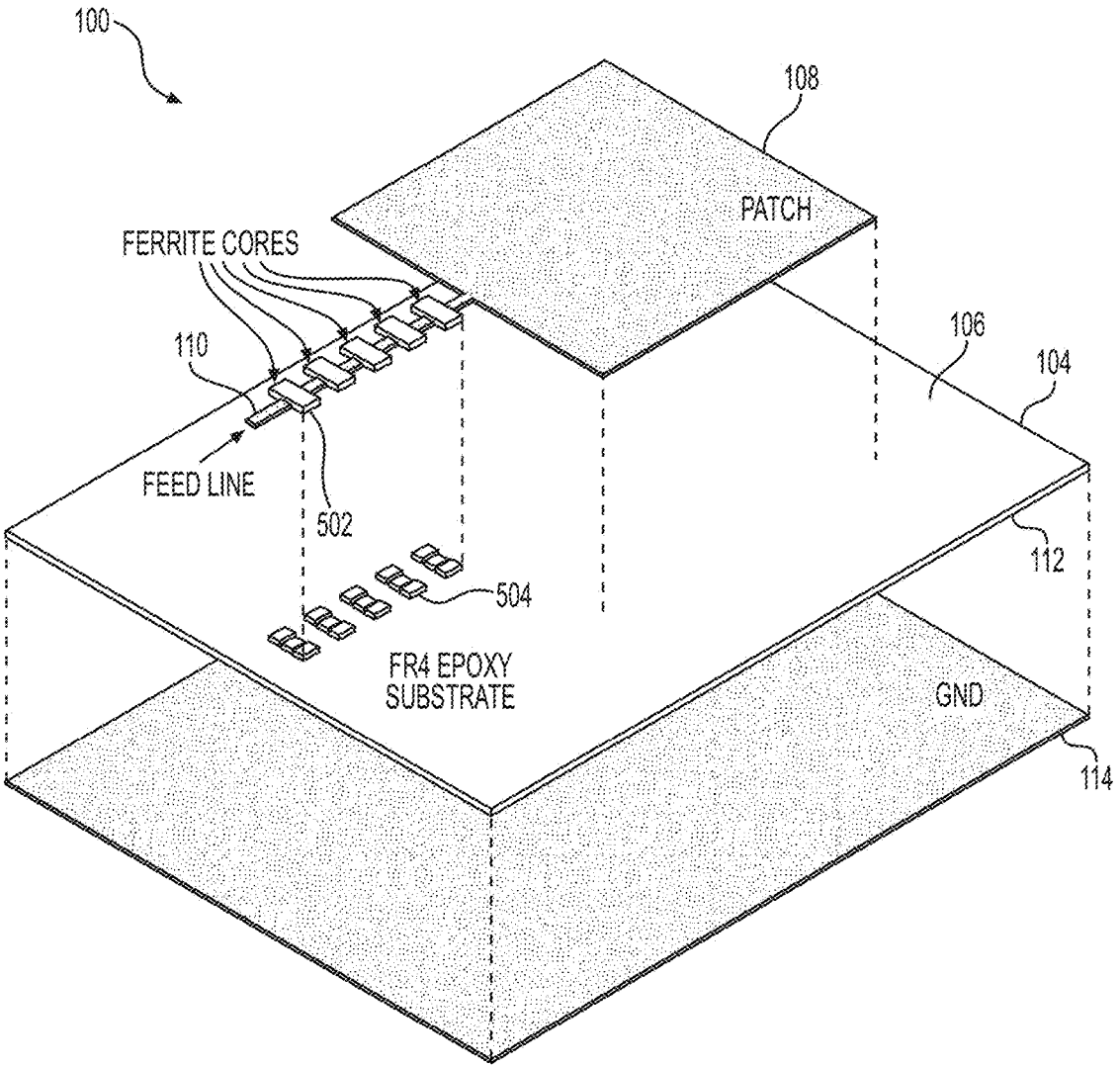
FIG. 5 depicts a diagram of components of the microstrip patch antenna of FIG. 2 in accordance with an illustrative embodiment.

FIG. 5 depicts a diagram of components of the microstrip patch antenna 100 of FIG. 2 in accordance with an illustrative embodiment. The microstrip patch antenna 100 includes the dielectric substrate 104 having, on the first side 106, the radiator body 108 in connection with the feedline 110 and, on the second side 112, the reflector ground plane 114. As shown, each ferrite core 102 includes a first portion 502 and a second portion 504 that are assembled to one another to form a continuous structure. The ferrite core 102 completely encompasses or partially encompasses the feedline 110.

FIGS. 6, 7, 8, 9, 10, 11, 12, 13, 14, 15, 16, 17 and 18, each depicts a diagram of an exemplary microstrip patch antenna 100 configured with one or more ferrite cores 102 in accordance with an illustrative embodiment.

Figure 6:
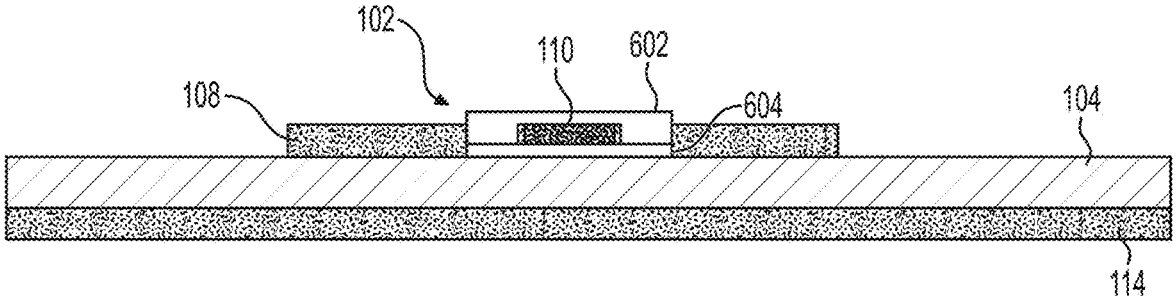
FIGS. 6, 7, 8, 9, 10, 11, 12, 13, 14, 15, 16, 17, and 18, each depicts a diagram of an exemplary microstrip patch antenna configured with one or more ferrite cores in accordance with an illustrative embodiment.

As shown in FIG. 6, the ferrite core 102 is coupled to a surface of the dielectric substrate 104. The ferrite core 102 includes a first portion 502 having a U-shaped cross-section (shown as 602) and a second portion 504 having a rectangular cross-section (shown as 604). In some embodiments, the feedline 110 has a thickness that is less than the thickness of the radiator body 108. This configuration enables a low-profile patch antenna with ferrite cores. In other embodiments, the thickness of the feedline 110 and the radiator body 108 is uniform.

Referring still to FIG. 6, the feedline 110 has a thickness that is less than the thickness of the radiator body 108. In other embodiments, the feedline 110 and radiator body 108 each has about the same thickness.

The first portion 502 and second portion 504, in some embodiments, are affixed to one another to form a unitary continuous structure. In some embodiments, the structure is formed by adhesives or thermal or ultrasonic welding processing. Other means to affixing ferrite material together may be employed.

Figure 7:
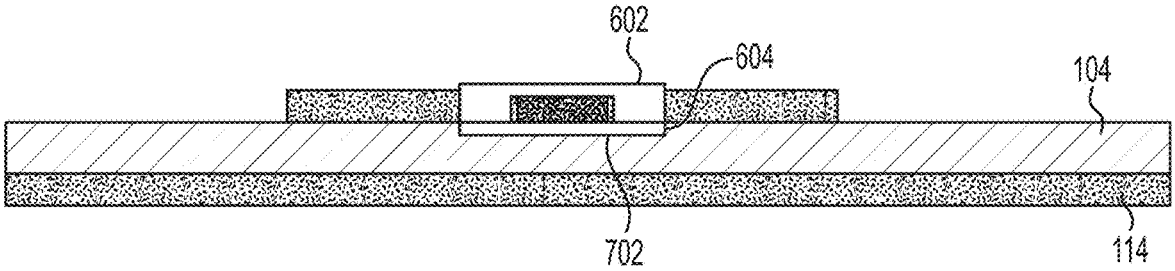

FIG. 7 depicts a diagram of an exemplary patch antenna with ferrite cores in accordance with another illustrative embodiment. Rather than being disposed on a uniformly flat surface of the dielectric substrate 104, the second portion 604 of the ferrite core is embedded within the dielectric substrate 104, which includes a recess 702 to seat the second portion 604. As shown, the second portion 604 couples to a first portion 602

Figure 8:
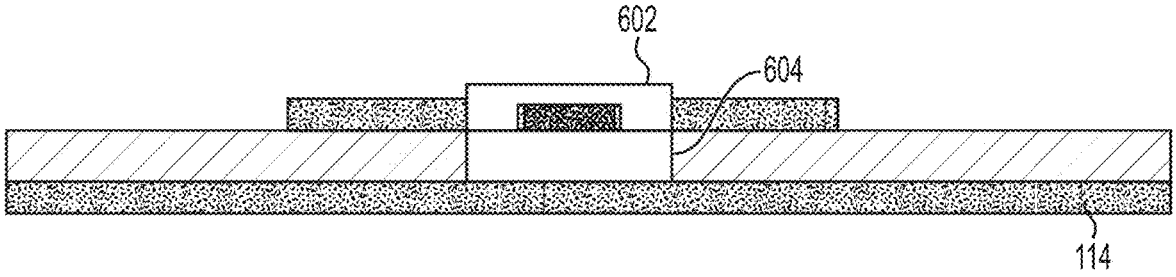

FIG. 8 depicts a diagram of an exemplary patch antenna with ferrite cores in accordance with another illustrative embodiment. The second portion 604 of the ferrite core 102 is coupled to a surface of the reflector ground plane 114. In some embodiments, the reflector ground plane 114 includes a recess for the second portion 604 to seat.

Figure 9:
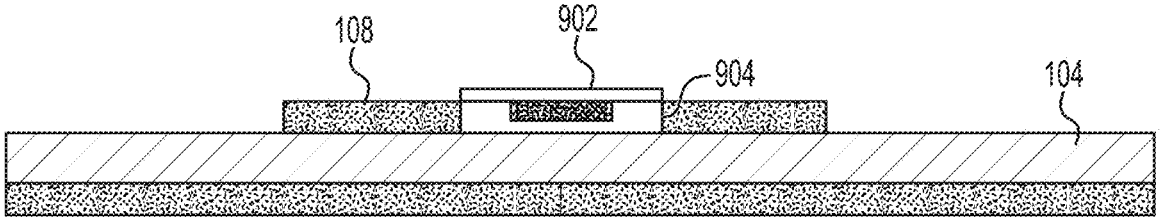
Figure 10:
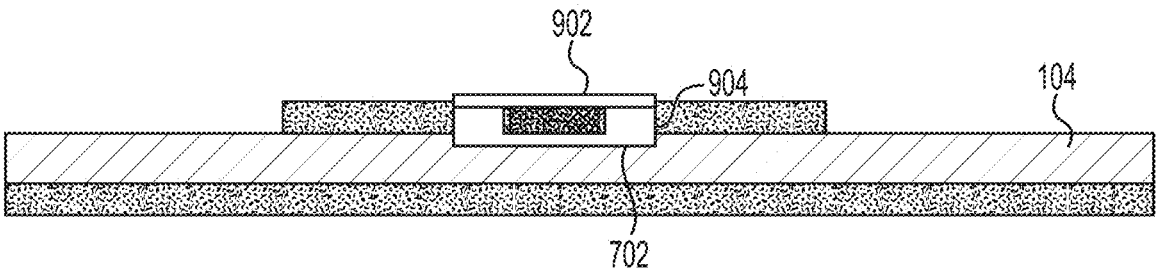
Figure 11:
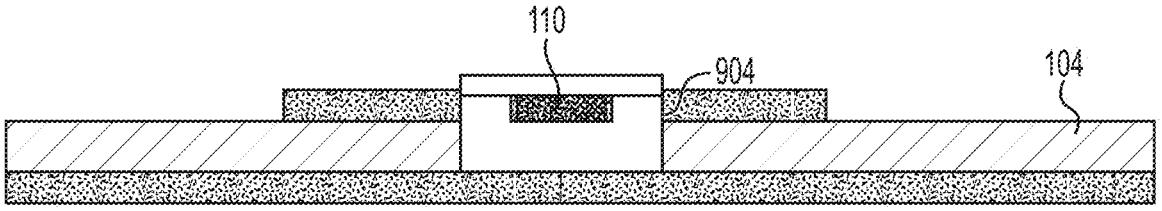

FIGS. 9, 10, and 11, each depicts a diagram of an exemplary patch antenna with ferrite cores in accordance with another illustrative embodiment. The ferrite core 102 includes a first portion 502 (shown as 902) having a rectangular cross-section and a second portion 504 (shown as 904) having a U-shaped cross section body, the first and second portions 502, 504 coupled to form a unitary body. As shown in FIG. 9, the second portion 904 contacts the dielectric substrate 104. The second portion 904 extends the thickness of the radiator body 108.

In FIG. 10, the second portion 904 is seated in a recess 702 of the dielectric substrate 104.

In FIG. 11, the second portion 904 has a thickness that extends the combined thickness of the dielectric substrate 104 and the feedline 110.

Figure 12:
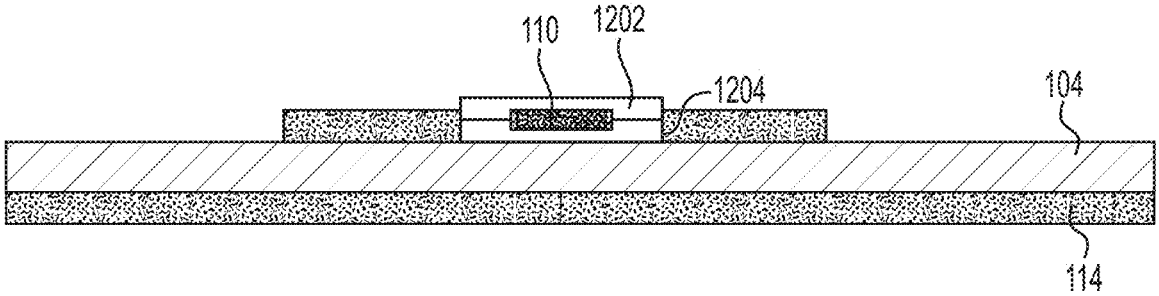

FIG. 12 depicts a diagram of an exemplary patch antenna with ferrite cores in accordance with another illustrative embodiment. The ferrite core 102 includes a first portion 502 (shown as 1202) and a second portion 504 (shown as 1204), each having a U-shaped cross section body. The first portion 1202 and second portion 1204 couples to form a unitary body structure. As shown, the second portion 1204 contacts the dielectric substrate 104. In other embodiments, the second portion 1204 is seated in a recess of the dielectric substrate. In yet another embodiment, the second portion 1204 has a body that extends the thickness of the dielectric substrate and contacts the reflector ground plane 114. In other embodiments, each of the first portion 1202 and second portion 1204 has an L-shaped cross section body.

FIGS. 13, 14, 15, and 16, each depicts a diagram of an exemplary patch antenna with ferrite cores in accordance with another illustrative embodiment. The ferrite cores 102 (shown as 1302) comprises a shaped structure that partially encompasses the feedline 110. The ferrite core 1302 may be shaped as a pot core, a U-shaped core, an E-shaped core, and a combination thereof.

Figure 13:
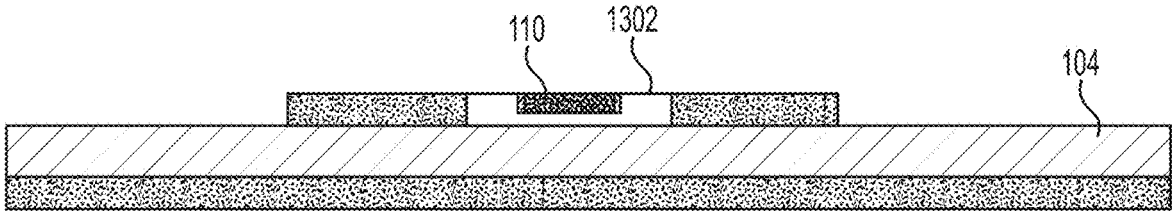

As shown in FIG. 13, the ferrite core 1302 contacts the dielectric substrate 104 and extends the thickness of the feedline 110.

Figure 14:
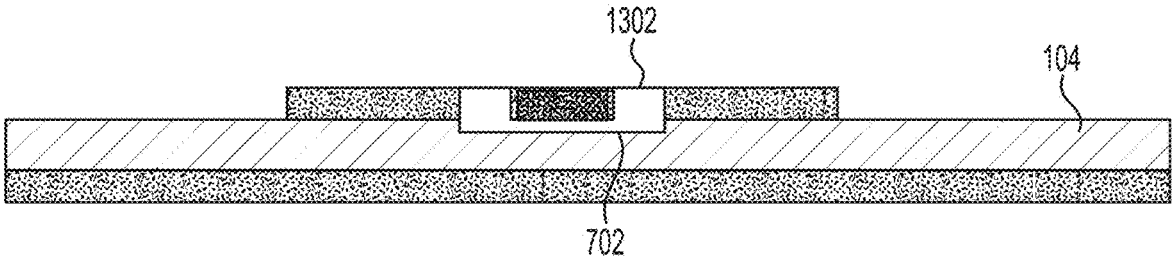

In FIG. 14, the ferrite core 1302 is seated in a recess 702 of the dielectric substrate 104.

Figure 15:
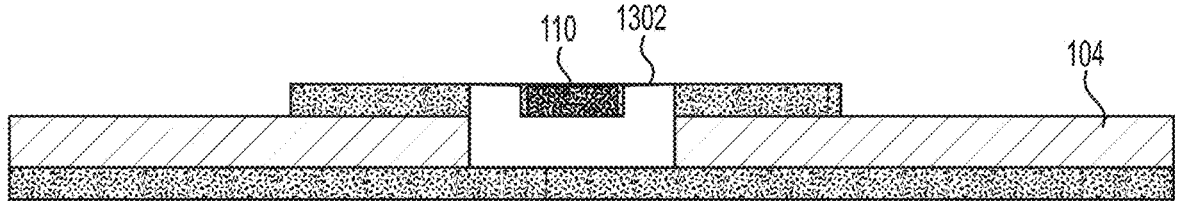

In FIG. 15, the ferrite core 1302 has a thickness that extends the combined thickness of the dielectric substrate 104 and the feedline 110.

Figure 16:
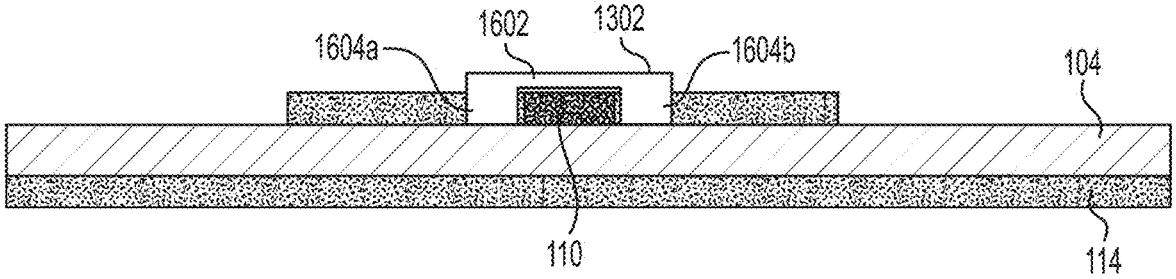

In FIG. 16, the ferrite core 1302 has a main body 1602 and side walls 1604 (shown as 1604*a* and 1604*b*), the side walls 1604 partially encompassing the feedline 110 to contact the dielectric substrate 104. In some embodiments, the ferrite core 1302 has a side wall 1604 that extends into the dielectric substrate 104. In other embodiments, the ferrite core 1302 has a side wall 1604 that extends to contact the reflector ground plane 114.

Figure 17:
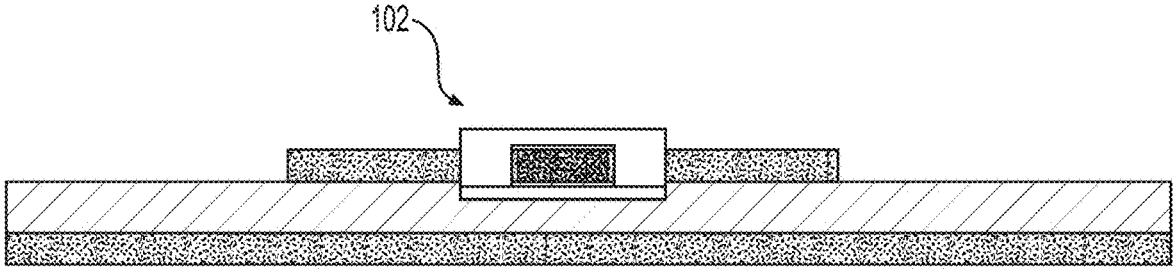
Figure 18:
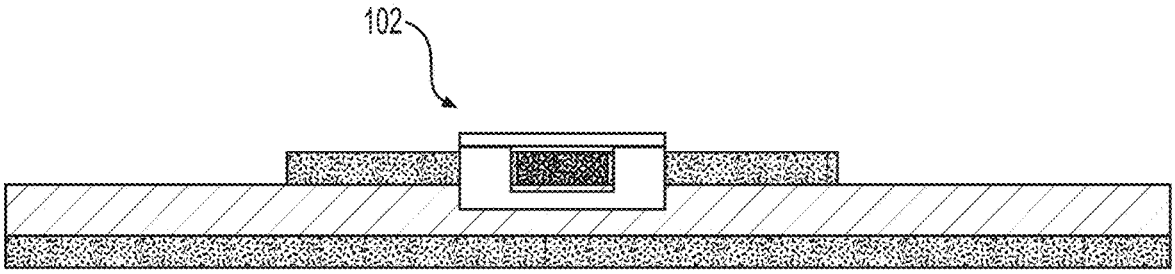

FIGS. 17 and 18, each depicts a diagram of an exemplary patch antenna with ferrite cores in accordance with another illustrative embodiment. As shown in the FIGS. 17 and 18, the ferrite cores 102 are not fixed to a give substrate of the patch antenna.

Figure 19:
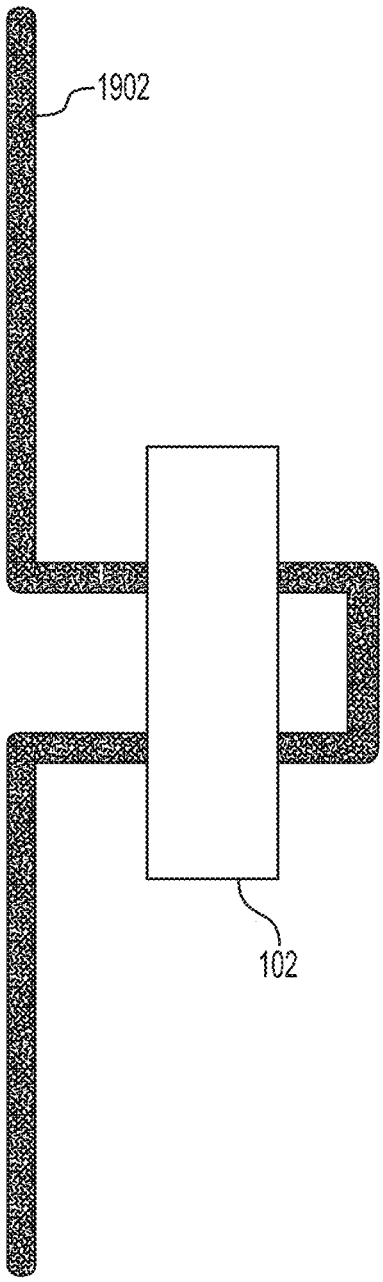
FIG. 19 depicts a diagram of an exemplary patch antenna with ferrite cores in accordance with another illustrative embodiment.

FIG. 19 depicts a diagram of an exemplary patch antenna with ferrite cores in accordance with another illustrative embodiment. The patch antenna includes a radiator body 108 that connects to a serpentine feedline 110 (shown as 1902) that loops across a given ferrite core 102 at multiple instances along a plane.

Various shapes and configurations of the ferrite cores 102 are discussed herein as illustrative non-limiting examples. Other shapes and configurations of the ferrite cores 102 may be used without departing from the spirit of the disclosure.

Simulation and Experiment of Multi-Strip Patch Antenna with Ferrite Cores

It is observed that multi-strip patch antenna with ferrite cores beneficially suppresses harmonic radiation (e.g., at the $2^{nd}$ and $3^{rd}$ harmonics, and greater) and effectively reduced back lobe in radiation pattern at the fundamental frequency.

Simulations and experiments with multi-strip patch antennas coupled with ferrite cores had been performed, which illustrate the performance of the array of multiple ferrite cores in suppressing radiation effects. It is observed that multi-strip patch antennas coupled with ferrite cores disclosed herein can significantly suppress harmonic radiation effects at the second and third harmonic frequencies. In particular, the simulation illustrates that an appropriate arrangement of the ferrite cores would retain peak realized gain at the fundamental frequency $f_0$. In addition, unwanted back lobe of radiation pattern at $f_0$ was observed to be significantly reduced. Because of such properties, harmonic suppressed patch antenna coupled with the ferrite cores can be beneficially used for active integrated antenna (AIA) applications.

FIGS. 20*a*, 20*b*, 20*c*, and 20*d* depict patch antenna designs with one or more ferrite cores. A first type of simulation was performed for a simulated single ferrite core patch antenna ("SFC-PA") 2002 shown in FIG. 20*a*. A second type of simulation was performed for a simulated multi-core ferrite patch antenna ("WC-PA") 2004 shown in FIG. 20*d*. The MFC-PA 2004 was fabricated and results thereof are compared to those of the simulated design.

In some embodiments, a patch antenna with photonic bandgap harmonic suppressed patch antenna may be used in conjunction with the exemplified methods and system. Examples of photonic bandgap harmonic suppressed patch antenna is described in Y. Horii and M. Tsutsumi, "Harmonic Control by Photonic Bandgap on Microstrip Patch Antenna," IEEE Microwave and Guided Wave Letters, vol. 9, pp. 13-15, 1999.

Figure 20A:
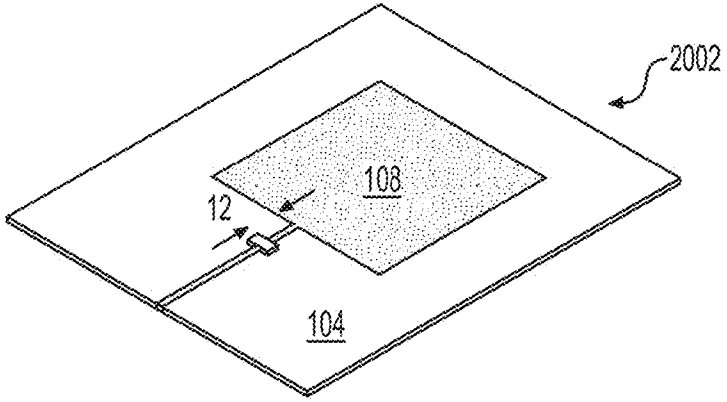
FIGS. 20*a*, 20*b*, 20*c*, and 20*d* depict patch antenna designs with one or more ferrite cores in accordance with an illustrative embodiment.
Figure 20B:
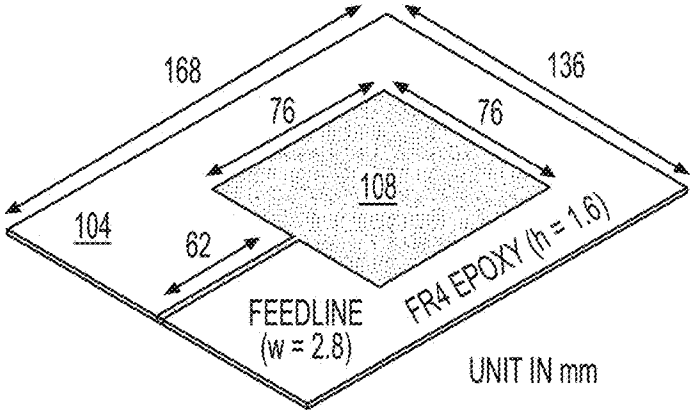
Figure 20C:
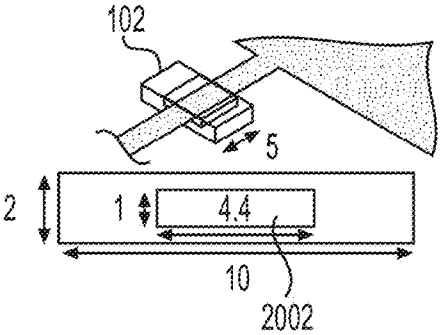

As shown in FIGS. 20*a*, 20*b*, and 20*c*, the simulated and fabricated SFC-PA 2002 has a copper radiator body 108 having a dimension of 76 mm×76 mm affixed to a dielectric substrate 104. The ferrite core 102 encompassed the feedline 110 and has an outer dimension of 10 mm×2 mm×5 mm and an inner dimension of 4.4 mm×1 mm×5 mm. Each radiator body in FIGS. 20*a*-20*d* was excited through a 50-Ohm microstrip feed line 110 (62 mm×2.8 mm).

Figure 20D:
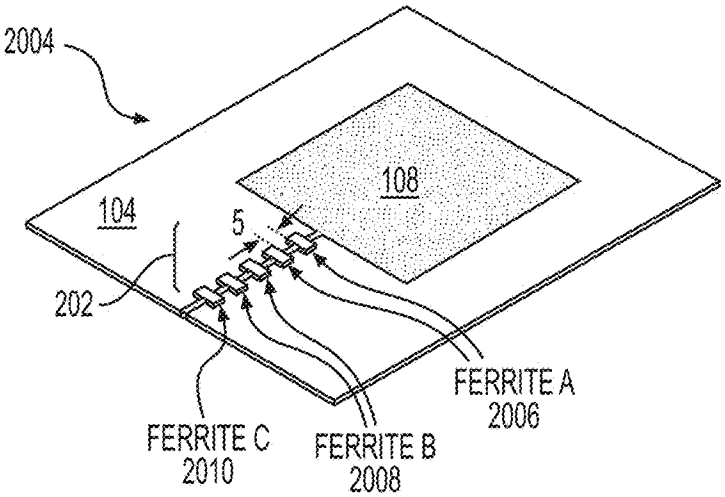

As shown in FIG. 20*d*, the ferrite cores 102 of the simulated and fabricated MFC-PA 2004 are arranged in an array 202. In this embodiment, each ferrite cores 102 is spaced 5 mm apart from each other. As discussed, the patch antenna for the MFC-PA 2004 has the same dimensions as the patch antenna for the simulated SFC-PA 2002. Ferrite cores with different permeability were used for the MFC-PA 2004, the configuration of the ferrite core array is shown in FIG. 20*d*. As shown in FIG. 20*d*, ferrite cores including Ferrite A (shown as "Ferrite A" 2006) comprising material $Ba_3Co_2Fe_{24}O_{41}$, Ferrite B (shown as "Ferrite B" 2008) $BaCo_{1.4}Zn_{0.6}Fe_{1.6}O_{27}$, and Ferrite C (shown as "Ferrite C" 2010) comprising material $Ba_2Co_2Fe_{12}O_{22}$.

Multiple ferrites, some of which having different permeability from, for example, different crystalline structures or materials, may be used to tailor the suppression of harmonics at different frequency ranges. In some embodiments, the permeability of the ferrite or a group thereof are tailored to provide, cumulatively, a low imaginary component (μ") at the fundamental frequency ($f_0$) and a high imaginary component (μ") at the harmonic frequencies desired to be suppressed.

Realized gain can be used to assess whether a ferrite core or array thereof can reduce harmonic radiation and, thus, remove unwanted signaled. In some embodiments, realized gain can be calculated via Equation 1 where η is the antenna efficiency, D is the directivity, and Γ is the reflection coefficient.

$$\text{Realized Gain}=\text{Gain}\cdot(1-1|\Gamma|^2)=\eta\cdot D\cdot(1-|\Gamma|^2) \quad \text{(Equation 1)}$$

Without wishing to be bound to a particular theory, the reflection coefficient Γ may be nearly negligible because of a good impedance matching in the noted frequency ranges. To this end, the realized gain (RP) may decrease at frequencies above the fundamental frequency $f_0$ because of a low antenna efficiency η. Decrease in the antenna efficiency η may result from the series impedance (Z) of the ferrite cores as, for example, shown in Equation 2 where R is the equivalent resistance ($R=\omega\mu''L_0$), X is the equivalent reactance ($X=\omega\mu'L_0$), and inductance $L_0=\mu_0N^2 A_e/L_e$ in which $\mu_0$ is the vacuum permeability, N is the number of turns, $A_e$ is the widest cross-sectional area of the ferrite core, and $L_e$ is the smallest inner diameter of the ferrite core.

$$Z=R+jX=j\omega L_0(\mu'-j\omega\mu'')=\omega\mu''L_0+j\omega\mu'L_0 \quad \text{(Equation 2)}$$

Figure 21:
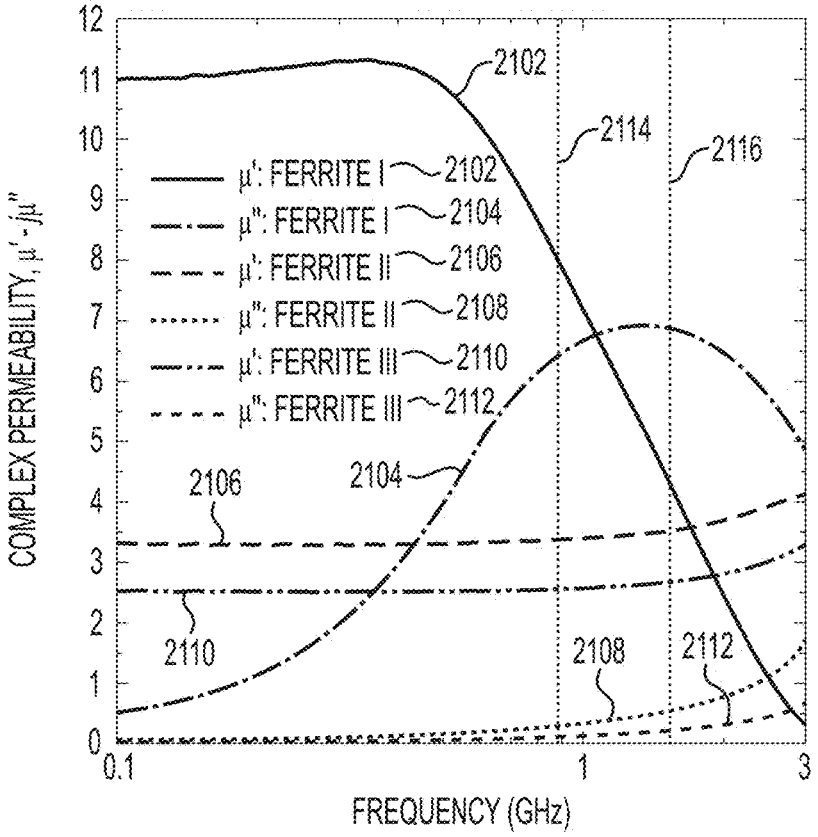
FIG. 21 shows example frequency dependence characteristics of real component (μ') and imaginary component of the complex permeability (μ'-jμ") for different measured ferrite materials for used in patch antennas (MFC-PAs) in accordance with an illustrative embodiment.
Figure 22:
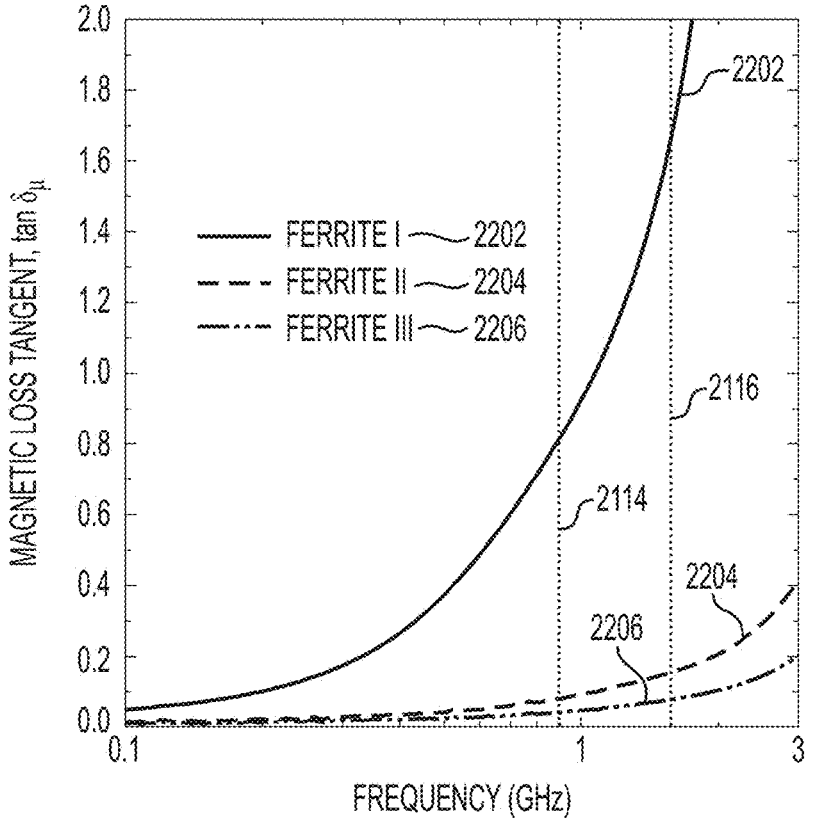
FIG. 22 shows corresponding magnetic loss tangent (tan $\delta_\mu$) derived from the real permeability (μ') and imaginary component of permeability (μ") of FIG. 21, in accordance with an illustrative embodiment.

FIG. 21 shows example frequency dependence characteristics of the real component (μ') and imaginary component (μ") of the complex permeability (μ'−jμ") for different measured ferrite materials for used in patch antennas (MFC-PAs) in accordance with an illustrative embodiment. Permeability is a measure of the ability of a material to support the formation of a magnetic field within itself. FIG. 22 shows corresponding magnetic loss tangent (tan $\delta_\mu$) derived from the real permeability (μ') and imaginary component of permeability (μ") of FIG. 21, in accordance with an illustrative embodiment. Magnetic loss tangent (tan $\delta_\mu$) may include hysteresis losses, Eddy current losses, and residual losses, among others.

As shown in FIG. 21, the μ" of Ferrite I is comparatively large above 900 MHz (at line 2104), which results in R increasing (per Equation 2). Consequently, antenna efficiency η decreases at harmonic frequencies desired to be suppressed. Specifically, as shown in FIG. 21, Ferrite A ($Ba_3Co_2Fe_{24}O_{41}$) has, at 900 MHz (shown at 2114) (e.g., a fundamental frequency $f_0$ of an example patch antenna in some embodiments), a real permeability μ' characteristics (shown as line 2102) of about 7.9 and a μ" characteristics (shown as line 2104) of about 6.48. Above 900 MHz, the μ' continues to decrease while the μ" increases up to 1.5 GHz (shown at 2116) and then decreases. As shown in FIG. 22, the resulting tan $\delta_\mu$ characteristics (shown as line 2202) (where tan $$\left(\text{where } \tan\delta_\mu = \frac{\mu''}{\mu'}\right)$$

is observed to increase sharply after 1 GHz and is expected to suppress harmonic radiation thereat. Ferrite B ($BaCo_{1.4}Zn_{0.6}Fe_{16}O_{27}$) shows a moderate μ' and μ" (shown as lines 2106 and 2108 respectively) that produces a moderate tan $\delta_\mu$ characteristics (shown as lines 2204). Ferrite C ($Ba_2Co_2Fe_{12}O_{22}$) shows the lowest μ' and tan $\delta_\mu$ characteristics (shown as lines 2110 and 2112, respectively). To this end, the combination of different complex permeability (μ' and μ") and corresponding magnetic loss tangent (tan $\delta_\mu$) characteristics may be selected to tailor a ferrite core array, e.g., by varying the ferrite material and crystalline structure, for a given application or a class of applications.

Table 1 shows measured μ' characteristics and tan $\delta_\mu$ characteristics for the ferrites I, II, and III shown in FIGS. 21 and 22. As shown in Table 1, frequency dependence characteristics of real permeability (μ') and magnetic loss tangent (tan $\delta_\mu$) may be modified based on crystalline structures of the cores. Specifically, in Table 1, and in FIGS. 21 and 22, the real permeability (μ') and magnetic loss tangent (tan $\delta_\mu$) characteristics of ferrite cores is illustrates for Ferrite A ($Ba_3Co_2Fe_{24}O_{41}$) and Ferrite B ($BaCo_{1.4}Zn_{0.6}Fe_{16}O_{27}$) subjected to high-temperature sintering or low-temperature sintering. Such techniques of varying the processing of the cores and the selection of the core material, among others, may be used to fine tune the real permeability (μ') and magnetic loss tangent (tan $\delta_\mu$) characteristics of individual ferrite cores within a ferrite core array. In some embodiments, the geometry of the ferrite core may be varied as will be discussed in relation to FIGS. 31*a* and 31*b*.

TABLE 1

| | Composition | Sintering Temperature | μ' 0.9 GHz | μ' 1.8 GHz | μ' 2.7 GHz | tan $\delta_\mu$ 0.9 GHz | tan $\delta_\mu$ 1.8 GHz | tan $\delta_\mu$ 2.7 GHz |
|---|---|---|---|---|---|---|---|---|
| Ferrite I | $Ba_3Co_2Fe_{24}O_{41}$ ($Co_2Z$) | 1300° C. | 7.9 | 3.1 | 0.7 | 0.82 | 2.15 | 7.69 |
| Ferrite II | $BaCo_{1.4}Zn_{0.6}Fe_{16}O_{27}$ ($Co_{1.4}Zn_{0.6}W$) | 1100° C. | 3.4 | 3.6 | 4.0 | 0.08 | 0.18 | 0.34 |
| Ferrite III | $BaCo_{1.4}Zn_{0.6}Fe_{16}O_{27}$ ($Co_{1.4}Zn_{0.6}W$) | 1000° C. | 2.6 | 2.7 | 3.1 | 0.04 | 0.09 | 0.17 |

In some embodiments, the ferrite cores are made of spinel ferrite, which may be a nickel-zinc (Ni—Zn) based ferrite composite, a manganese-zinc (Mn—Zn) based ferrite composite, a nickel-zinc-copper (Ni—Zn—Cu) based ferrite composite, a nickel-manganese-cobalt (Ni—Mn—Co) based ferrite composite, a cobalt (Co) based ferrite, lithium-zinc (Li—Zn) based ferrite composite, or a lithium-manganese (Li—Mn) based ferrite composite. Other materials may be selected based on the real permeability (μ') and magnetic loss tangent (tan $\delta^{\mu}$) characteristics of the material.

Examples of the various crystalline structures for hexagonal ferrites that may be used for harmonic radiation suppression include, but are not limited to, an M-type hexaferrite, a Y-type hexaferrite, a Z-type hexaferrite, a W-type ferrite composite, an X-type hexaferrite, and U-type hexaferrite. Other processing techniques may be used to vary the crystalline structure of the ferrite core to vary its real permeability (μ') and magnetic loss tangent (tan $\delta^{\mu}$) characteristics.

Other examples techniques for processing ferrite cores are described in Jaejin Lee et al., "Low loss $Co_2Z$ ($Ba_3Co_2Fe_{24}O_{41}$)—glass composite for gigahertz antenna application," Journal of App. Phys. 109, 07E530 (2011), the text of which is incorporated by reference herein in its entirety.

FIGS. 23*a*, 23*b*, and 23*c*, respectively show simulated surface current distribution for a patch antenna without ferrite cores (PA) at the fundamental frequency (FIG. 23*a*), at the second harmonic frequency (FIG. 23*b*), and at the third harmonic frequency (FIG. 23*c*). FIGS. 24*a*, 24*b*, and 24*c*, respectively show simulated surface current distribution for a multi-ferrite core patch antenna (MFC-PA) at the same harmonic frequencies (see FIGS. 24*a*, 24*b*, and 24*c*). It is observed (see FIGS. 24*b* and 24*c*) that the surface current distribution at the second and third harmonic frequencies are attenuated and more uniform (as compared to FIGS. 23*b* and 23*c*). Thus, the interference from such frequencies have been significantly suppressed. The simulations of antenna performance were performed with ANSYS High Frequency Structure Simulator (HFSS).

Without wishing to bound to a particular theory, in some embodiments, the MFC-PA can effectively suppress harmonic radiation by not redirecting or reflecting, thereby removing unwanted signals, while maintaining the reasonable radiation characteristics at $f_0$. As shown in FIGS. 23*a*-23*c* and 24*a*-24*c*, large surface current flows into the rectangular patch radiator of PA, but there is a weak current on the radiators 108 of the MFC-PA 2004 at $f_2$ and $f_3$. In FIGS. 24*b* and 24*c*, it is observed that the current of the input power in the feedline is reflected back to the source while also gets weaker when the current passes through each core (illustrating the efficacy of the ferrite cores in this design).

Figure 25:
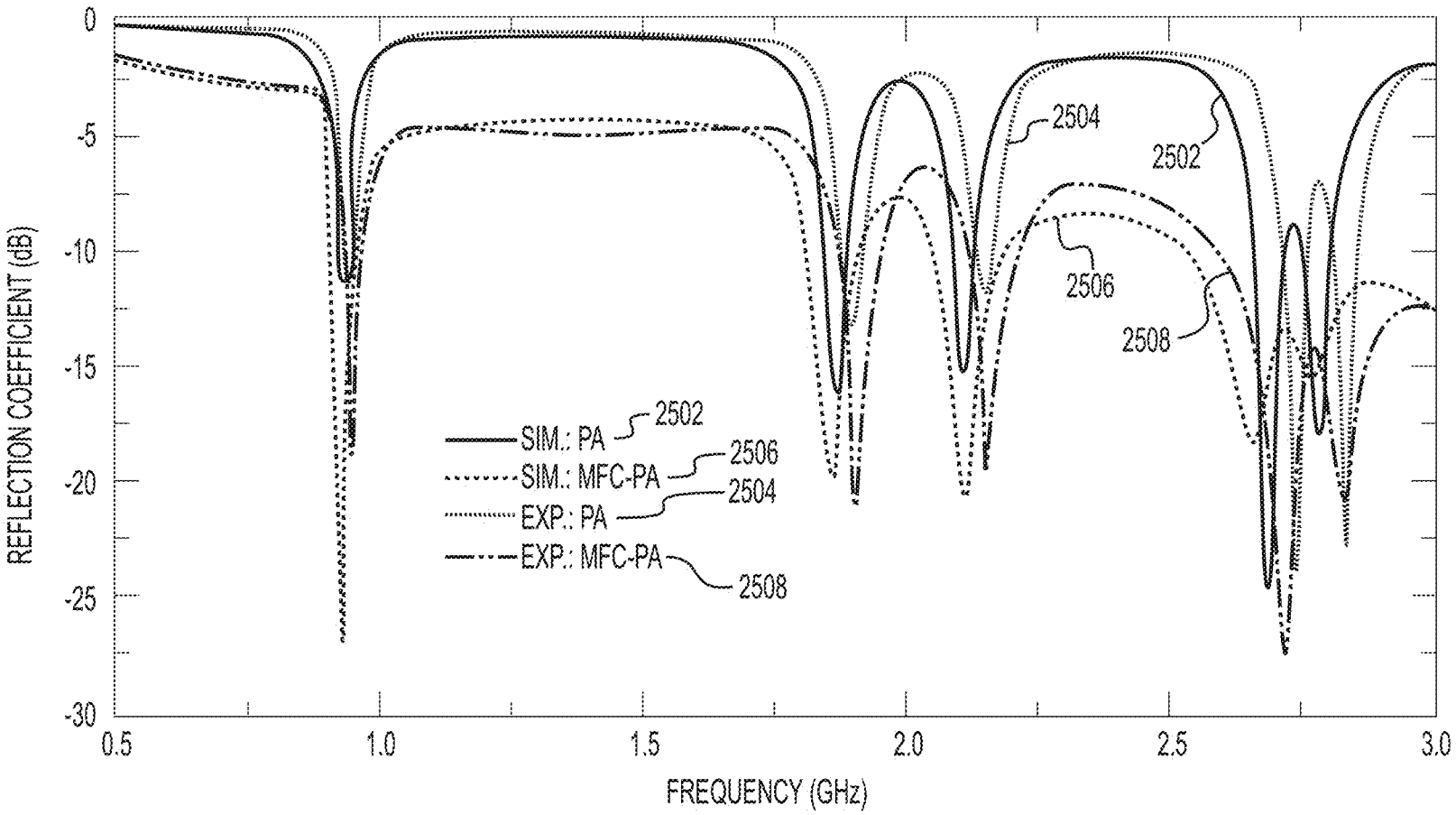
FIG. 25 shows a plot of simulated and experimental results comparing scattering parameters (S-parameters) for the simulated and measured multi-ferrite core patch antenna (MFC-PA) and the patch antenna without ferrite core (PA) of FIGS. 20*b* and 20*d*.

FIG. 25 shows a plot of a comparison of simulated and experimental scattering parameters (S-parameters) for the simulated and measured multi-ferrite core patch antenna (MFC-PA) and the patch antenna without ferrite core (PA) of FIGS. 20*b* and 20*d*. As shown in FIG. 25 and summarized in Table 2, in the simulation, the PA design (corresponding to line 2502) resonates at 0.93, 1.87, and 2.78 GHz, which correspond to the fundamental frequency ($f_0$), the second harmonic frequency ($f_2=2f_0$), and the third harmonic frequency ($f_3=3f_0$) while the measured PA is measured to resonate at 0.95, 1.90, and 2.84 GHz. The simulated return losses at $f_0$, $f_2$, and $f_3$ of the PA design are observed at 11 dB, 16 dB, and 18 dB, respectively, while the measured return loss are observed at 10 dB, 13 dB, and 23 dB. Similar to the simulated and measured PA design, the simulated MFC-PA design (corresponding to lines 2506 and 2508) shows clear resonances at $f_0$, $f_2$, and $f_3$ (at 0.93, 1.86, and 2.77 GHz, respectively) that provide a respective return loss of 26 dB, 20 dB, and 16 dB, while the measured MFC-PA design shows a return loss 19 dB, 21 dB, and 21 dB (at 0.95, 1.91, and 2.83 GHz, respectively). The measured S-parameters for PA design (corresponding to line 2504) and MFC-PA design (corresponding to line 2508) are observed to be in good agreement with simulated S-parameters (corresponding to lines 2502 and 2506) for the same.

TABLE 2

| Antenna Type | | PA | MFC-PA |
|---|---|---|---|
| Fundamental frequency | Sim. | 0.93 GHz | Fundamental frequency |
| | Mea. | 0.95 GHz | 0.95 GHz |
| $2^{nd}/3^{rd}$ harmonic frequency | Sim. | 1.87/2.78 GHz | $2^{nd}/3^{rd}$ harmonic frequency |
| | Mea. | 1.9/2.84 GHz | 1.91/2.83 GHz |
| Return loss at fundamental frequency | Sim. | 11 dB | Return loss at fundamental frequency |
| | Mea. | 10 dB | 19 dB |
| Return loss at $2^{nd}/3^{rd}$ harmonic frequency | Sim. | 16/18 dB | Return loss at $2^{nd}/3^{rd}$ harmonic frequency |
| | Mea. | 13/23 dB | 21/21 dB |

Figure 26A:
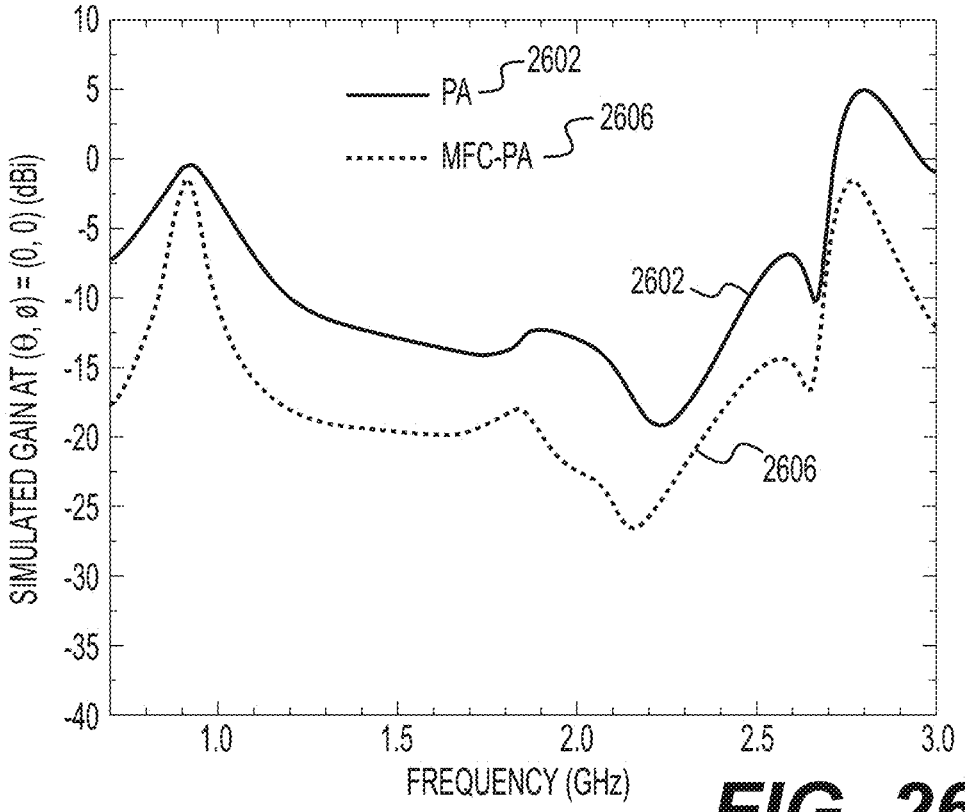
FIG. 26*a* shows a plot of results comparing frequency dependent gain for the simulated multi-ferrite core patch antenna (MFC-PA) and the patch antenna without ferrite core (PA) of FIGS. 20*b* and 20*d*.
Figure 26B:
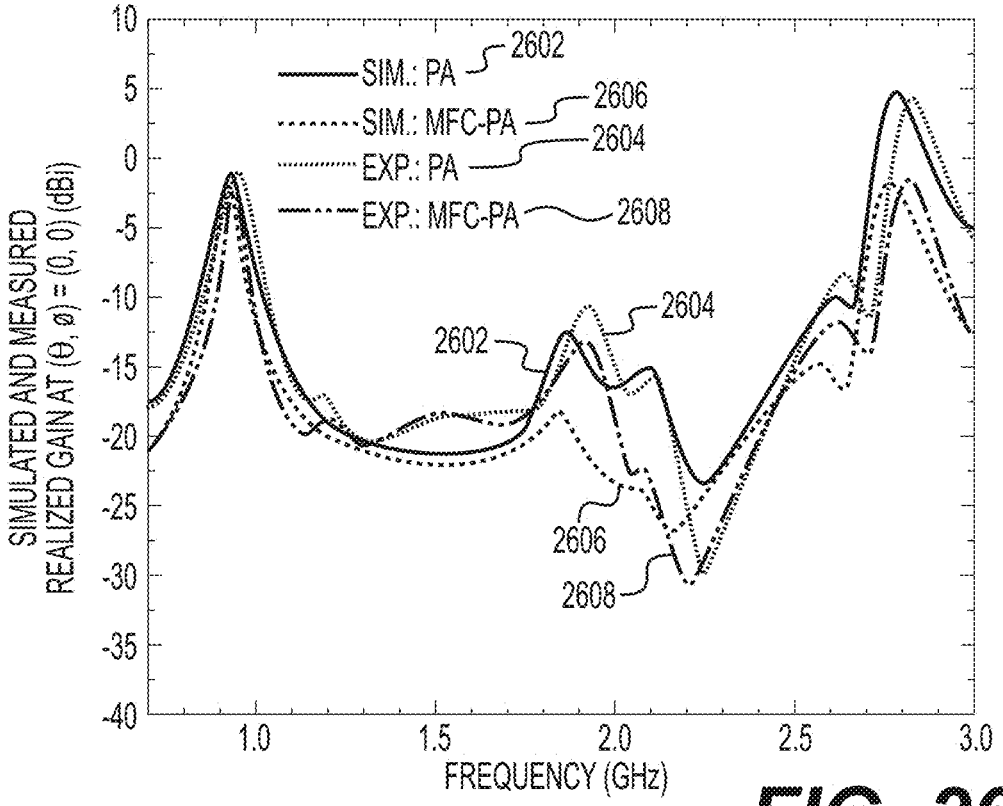
FIG. 26*b* shows a plot of results comparing frequency dependent realized peak gain for the simulated and measured multi-ferrite core patch antenna (MFC-PA) and the patch antenna without ferrite core (PA) of FIGS. 20*b* and 20*d*.

FIG. 26*a* shows a plot of results comparing frequency dependent gain ("G") for the simulated multi-ferrite core patch antenna (MFC-PA) and the patch antenna without ferrite core (PA) of FIGS. 20*b* and 20*d* at (θ, ϕ)=(0, 0). FIG. 26*b* shows a plot of results comparing frequency dependent realized peak gain ("RG") for the various simulated and measured designs of FIGS. 20*b* and 20*d* at (θ, ϕ)=(0, 0). As shown in FIG. 26*a* and FIG. 26*b*, it is clearly observed that the simulated and measured MFC-PA design (shown via the peak gain of the MFC-PA design corresponding to lines 2606 and 2608) suppressed antenna gain (G) and realized antenna gains (RP) at harmonic frequencies, $f_2$ and $f_3$, more effectively than the PA design (shown at lines 2602 and 2604) without disturbing gain at the fundamental frequency ($f_0$). Without wishing to a bound to a particular theory, this is because the ferrites possess high permeability and are highly lossy; therefore, unwanted signals were significantly attenuated at frequencies above $f_0$. The simulated and measured realized antenna gains (RP) of the PA and MFC-PA designs are summarized in Table 3.

TABLE 3

| Realized Gain | PA | MFC-PA |
|---|---|---|
| At fundamental frequency | −0.8/−1.2 dBi | −1.9/−2.7 dBi |
| At $2^{nd}$ harmonic frequency | −13/−10 dBi | −18/−14 dBi |
| At $3^{rd}$ harmonic frequency | 4.8/4.4 dBi | −1.6/−1.7 dBi |

Figure 27A:
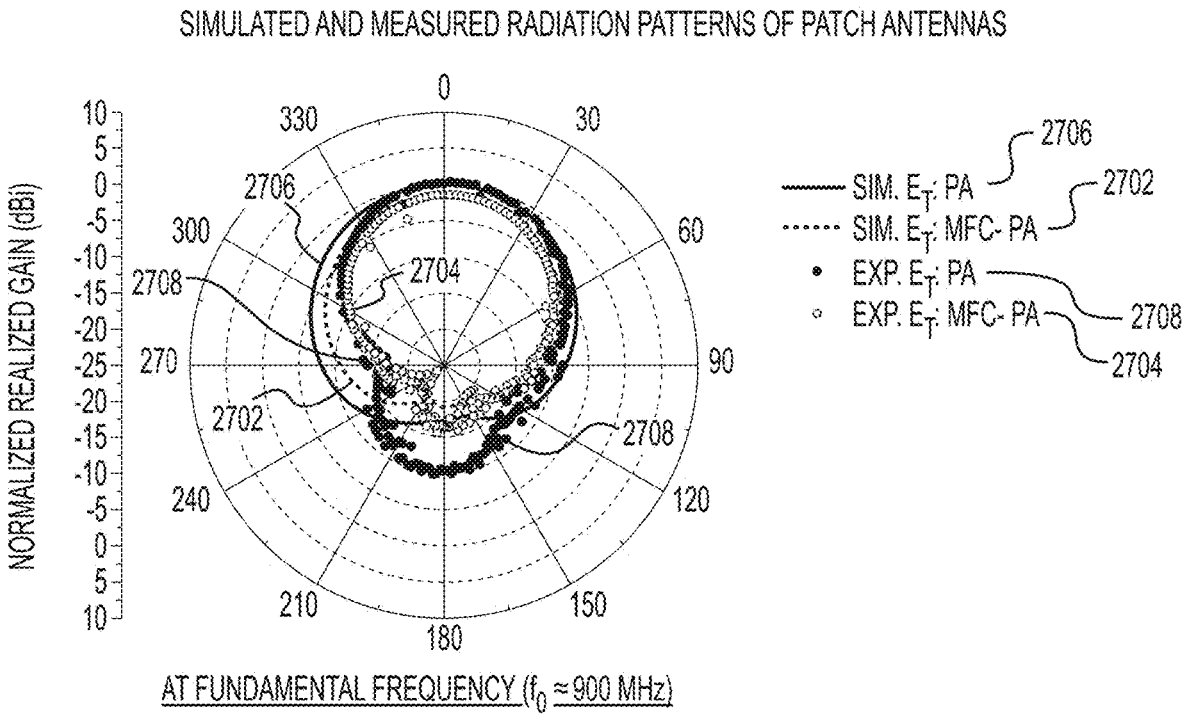
FIGS. 27*a*, 27*b*, and 27*c*, respectively show E-plane plots of normalized radiation patterns of the simulated and fabricated patch antenna and multi-ferrite core patch antenna of FIGS. 20*b* and 20*d* at the fundamental frequency $f_0$, the second harmonic frequency $f_2$, and the third harmonic frequency $f_3$.
Figure 27B:
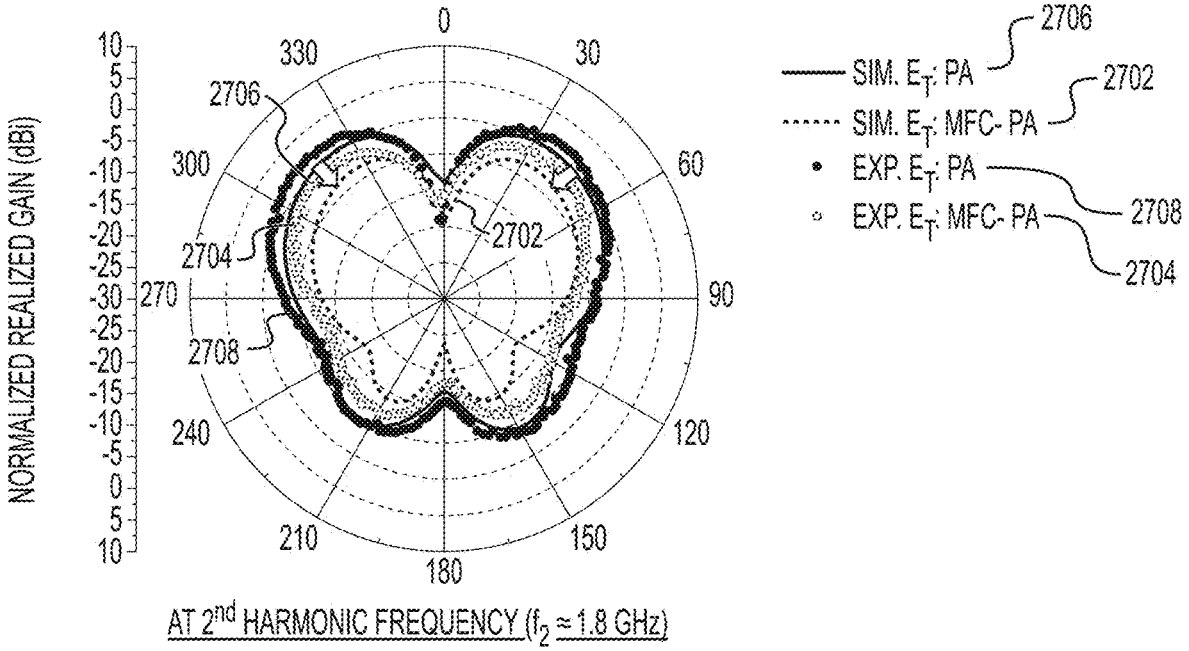
Figure 27C:
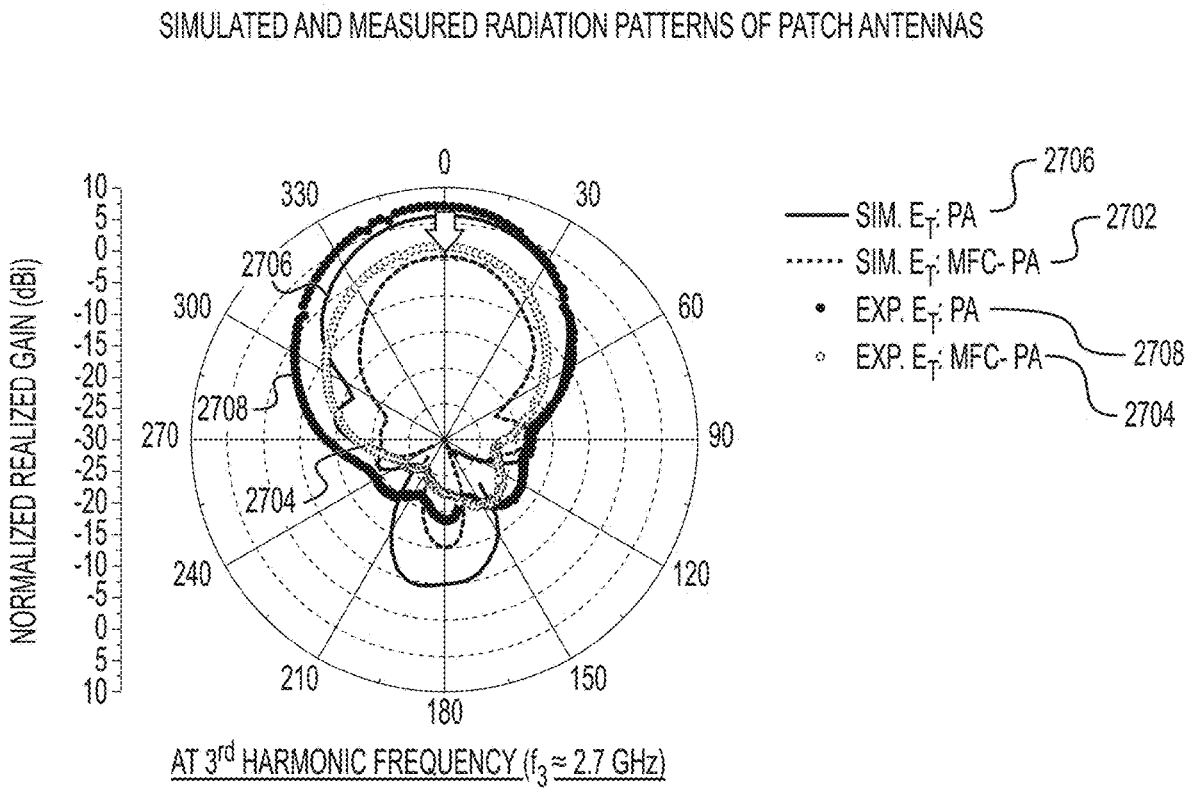

FIGS. 27*a*, 27*b*, and 27*c*, respectively, show normalized radiation patterns of the simulated and fabricated patch antenna and the multi-ferrite core patch antenna in E-plane of FIGS. 20*b* and 20*d* at $f_0$ (FIG. 27*a*), $f_2$ (FIG. 27*b*), and $f_3$ (FIG. 27*c*). Antenna gain patterns of the simulated MFC-PA design (corresponding to line 2702) and fabricated MFC-PA design (corresponding to line 2704) at $f_2$ and $f_3$ are observed to be significantly suppressed as compared to that of the simulated and fabricated PA design (corresponding to lines 2706 and 2708). It should be noted that radiation pattern at $f_1$ is almost identical for simulated and fabricated PA and MFC-PA designs. In addition, the MFC-PA design shows a cross polarization discrimination (XPD) of 20.8 dB at f0 in the direction of $\theta=0°$ at $\phi=0°$.

Example Communication System

Figure 28:
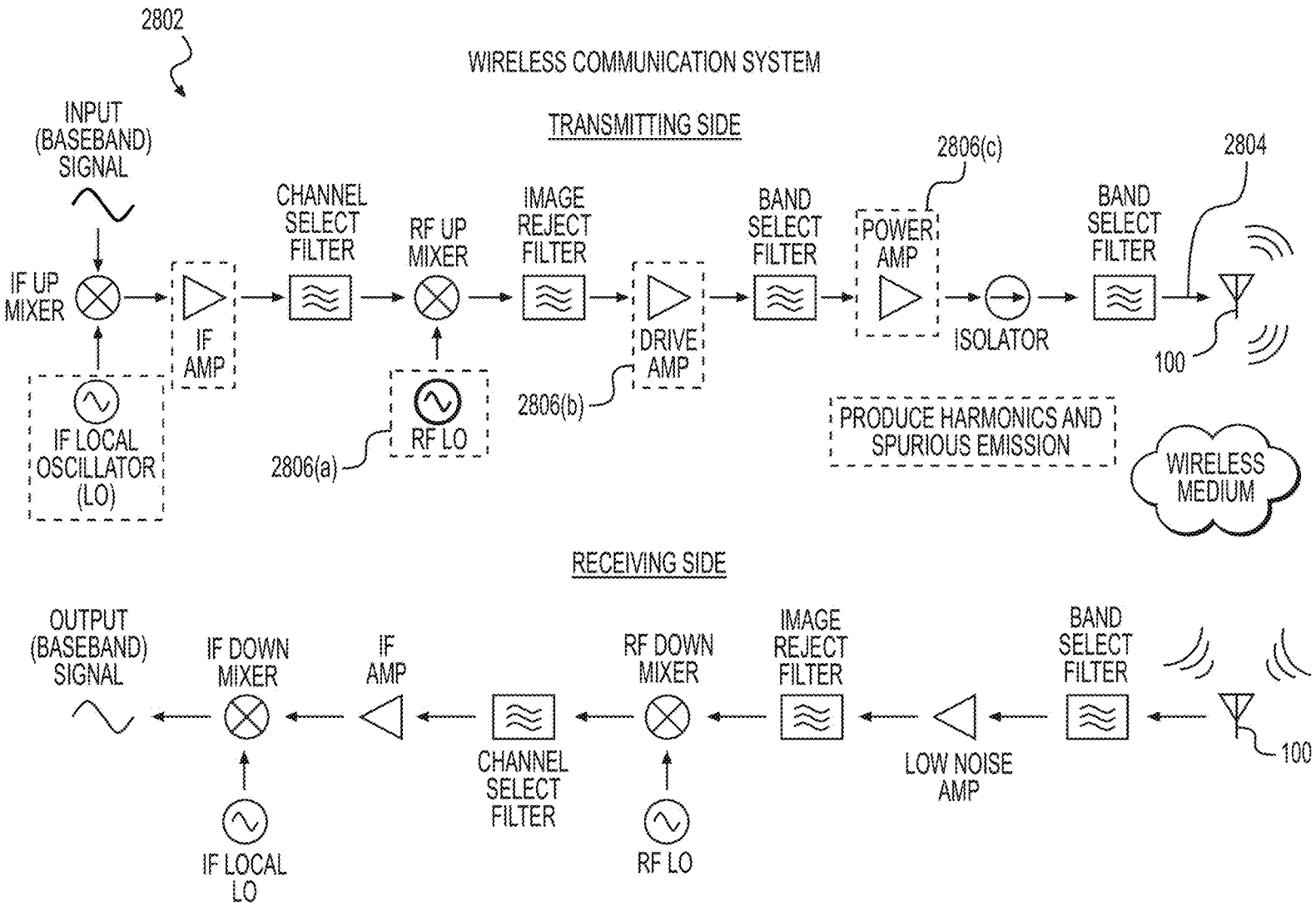
FIG. 28 is a diagram illustrating an exemplary communication circuit (including one or more power devices) that is coupled to a microstrip patch antenna having ferrite cores in accordance with an illustrative embodiment.

FIG. 28 is a diagram illustrating an exemplary communication circuit (including one or more power devices) that is coupled to a microstrip patch antenna 100 having ferrite cores in accordance with an illustrative embodiment. The communication circuit 2802 is configured to generate a transmission signal 2804 (e.g., having a fundamental frequency at 16.25 MHz, 33.75 MHz, 900 MHz, 2.4 GHz, 4.9 GHz, 5.0 GHz, 5.9 GHz, 60 GHz), said transmission signal 2804 having harmonics distortions at a second and third harmonic frequencies from (e.g., radiation effects of) components 2806 (shown as 2806*a*, 2806*b*, and 2806*c*) of the communication circuit, wherein the one or more ferrite cores are configured to suppress (e.g., significantly suppress) harmonic distortions (e.g., greater than −15 dB or more) at the second and the third harmonic frequencies.

Example Operation of the Patch Antenna with Ferrite Core

Figure 29:
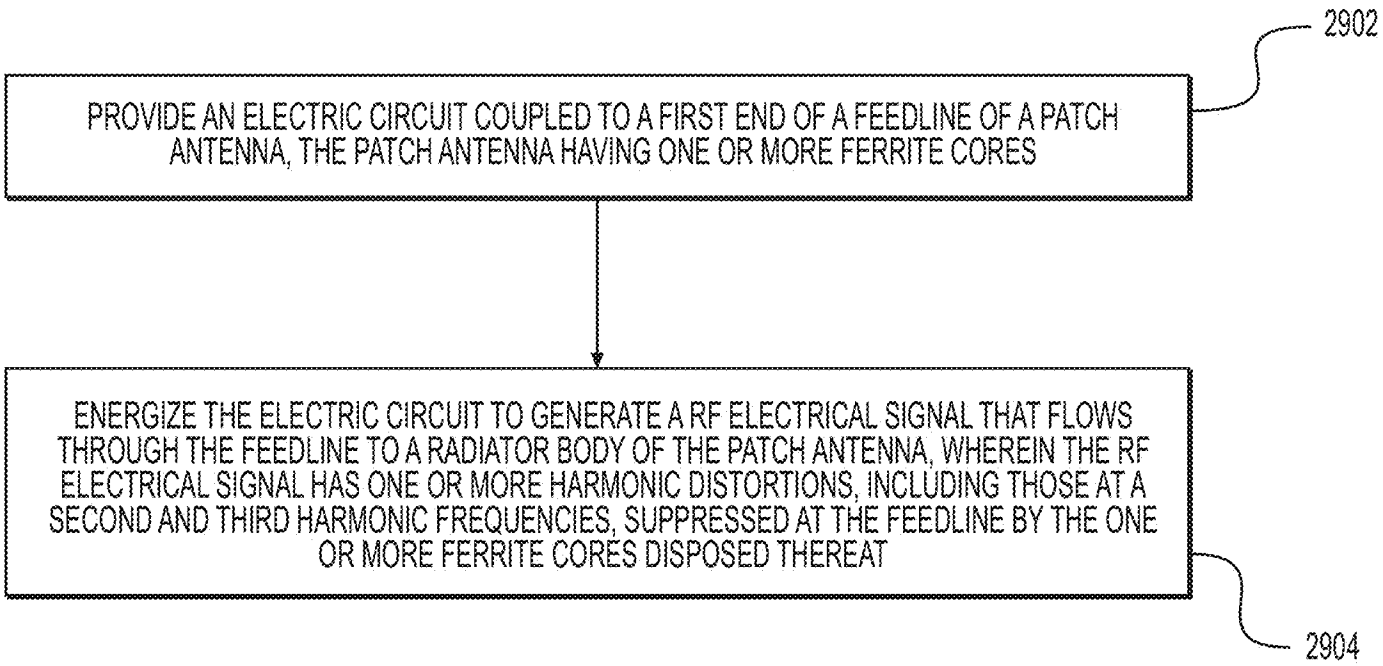
FIG. 29 depicts a flow diagram of a method of using a microstrip patch antenna coupled with ferrite cores in accordance with an illustrative embodiment.

FIG. 29 depicts a flow diagram of a method of using a microstrip patch antenna coupled with ferrite cores in accordance with an illustrative embodiment. The method 2900 includes providing an electric circuit (e.g., a communication circuit) coupled to a first end of a feedline of a patch antenna, the patch antenna having one or more ferrite cores proximal to the feedline at a respective distance from the radiator body (step 2092). The method 2900 further includes energizing the electric circuit to generate a RF electrical signal that flows through the feedline to a radiator body of the patch antenna, wherein the RF electrical signal has one or more harmonic distortions, including those at a second and third harmonic frequencies, suppressed at the feedline by the one or more ferrite cores disposed thereat (step 2904).

Fabricated Patch Antenna with Multiple Ferrite Core

Figure 30A:
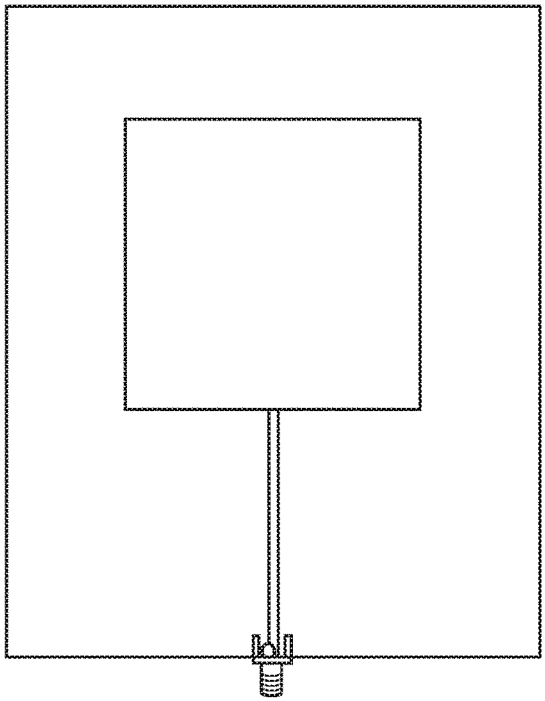
FIGS. 30*a*, 30*b*, 30*c*, and 30*d* are photos of a fabricated patch antenna and multi-ferrite core patch antenna as discussed in relation to FIGS. 20*b* and 20*d*.
Figure 30B:
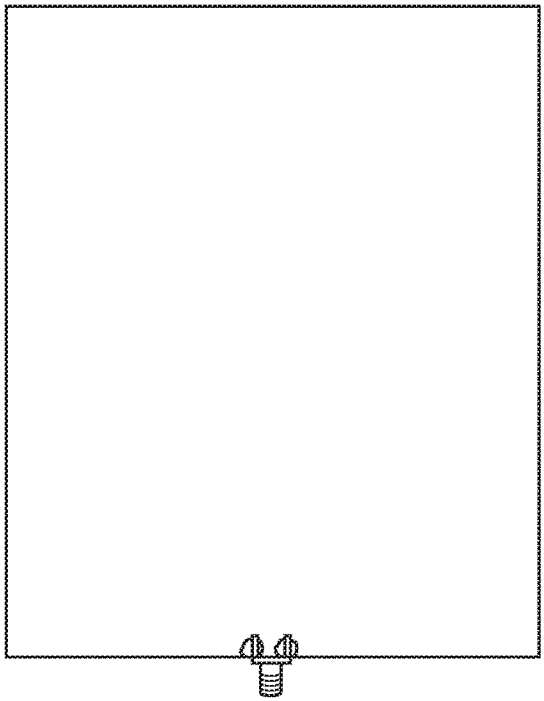
Figure 30C:
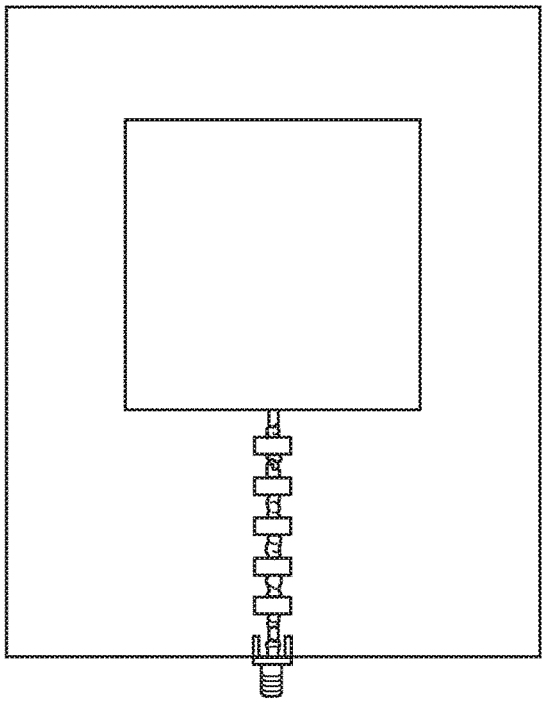
Figure 30D:
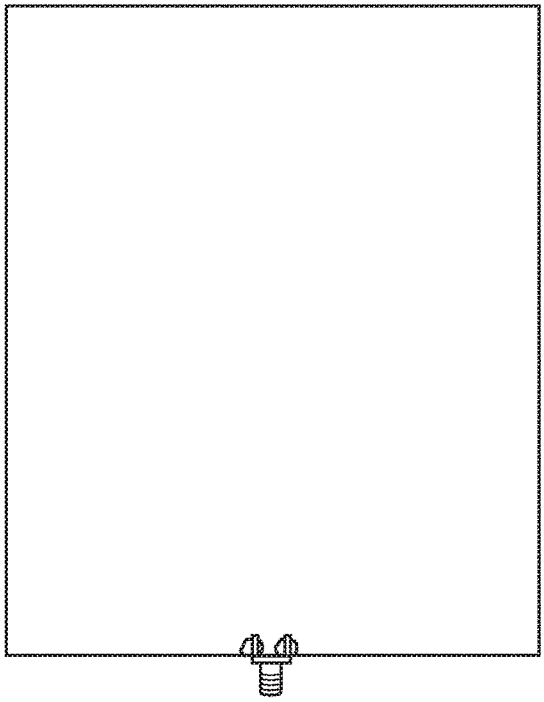

FIGS. 30*a*, 30*b*, 30*c*, and 30*d* show photo-images of fabricated PA and MFC-PA of FIGS. 20*b* and 20*b*. As shown in FIGS. 30*c* and 30*d*, the MFC-PA 2002 is fabricated with a ferrite-cored feed line using Ferrite I, II, and III cores as described in relation to Table 1. The fabricated PA and MFC-PA are characterized with a vector network analyzer (VNA: Agilent N5230) in an anechoic chamber (Raymond EMC QuietBox AVS 700) for S-parameters and antenna radiation performance.

Example Effect of Ferrite Length

Figure 31B:
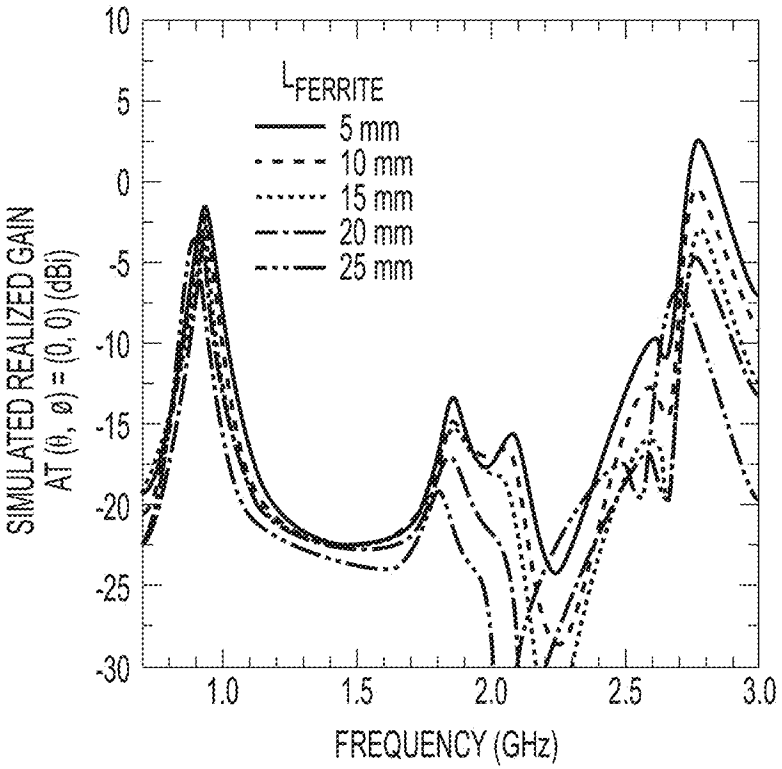
FIGS. 31*a* and 31*b* show plots of simulated results comparing resulting reflection coefficients and realized gain with various ferrite length ($L_{ferrite}$).
Figure 31A:
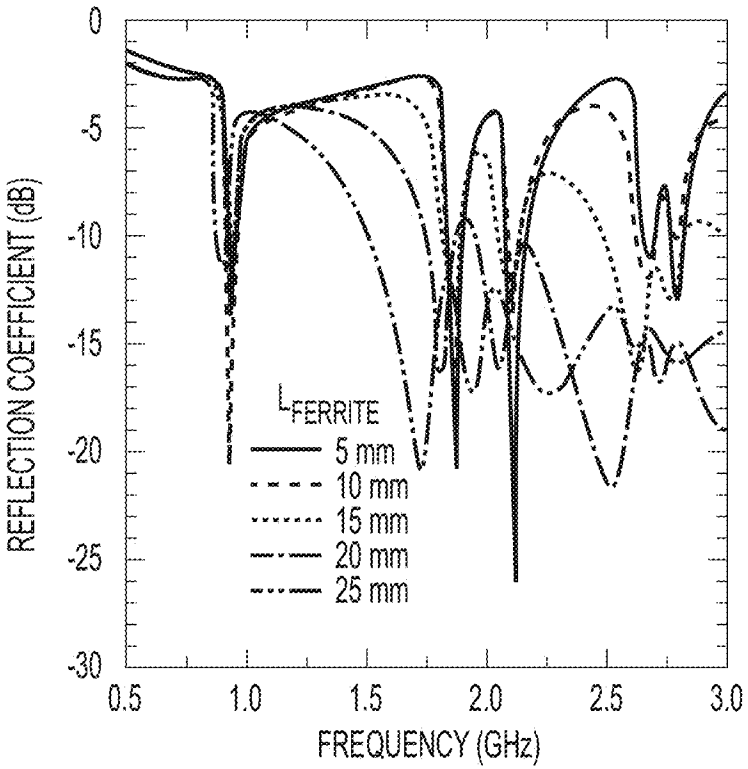

FIGS. 31*a* and 31*b* show plots of simulated results comparing resulting reflection coefficients and realized gain with various ferrite length ($L_{ferrite}$). As shown in FIG. 31*a*, regardless of the length of ferrite, the PA with ferrite core resonates at harmonic frequencies and the resonant frequency and return loss (RL) can vary with the inductance $L_0$ due to the different $A_e$ of the ferrite core. It is observed that the realized gain (RG) at the harmonic frequencies decreases with increasing ferrite length $L_{ferrite}$. Without wishing to be bound to a particular theory, this is because the R is proportional to $A_e$ of the ferrite.

While the methods and systems have been described in connection with preferred embodiments and specific examples, it is not intended that the scope be limited to the particular embodiments set forth, as the embodiments herein are intended in all respects to be illustrative rather than restrictive.

In some embodiments, other harmonics (e.g., $4^{th}$, $5^{th}$, $6^{th}$, etc.) radiation may be suppressed using the exemplified methods and system disclosed herein.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

In addition to communication systems, the exemplified methods and systems may be used in applications and fields, such a medical equipment and devices, and etc., to address harmonics and spurious emissions from radio frequency interference (RFI).

Throughout this application, various publications may be referenced. The disclosures of these publications in their entireties are hereby incorporated by reference into this application in order to more fully describe the state of the art to which the methods and systems pertain.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A system comprising:

a patch antenna comprising a dielectric substrate having, on a first side, a radiator body in connection with a feedline and, on a second side, a reflector ground plane; and one or more ferrite cores, including a first ferrite core, coupled to the dielectric substrate proximal to the feedline, wherein the first ferrite core completely encapsulates the feedline, wherein the first ferrite core comprises a first member having a first surface and a second surface, and wherein the first member is disposed at the dielectric substrate such that the first surface is in direct contact with the reflector ground plane or with a portion of the dielectric substrate.

2. The system of claim 1, comprising a circuit configured to generate a signal, said signal having one or more harmonic distortions from components of the circuit, wherein the one or more ferrite cores are configured to suppress at least one of the one or more harmonic distortions of the signals.

3. The system of claim 1, comprising a communication circuit configured to generate a transmission signal, said transmission signal having harmonics distortions at a second and third harmonic frequencies from components of the communication circuit, wherein the one or more ferrite cores are configured to suppress harmonic distortions at the second and the third harmonic frequencies.

4. The system of claim 1, further comprising:

a second ferrite core, wherein first ferrite core and the second ferrite core, collectively, form an array of ferrite cores.

5. The system of claim 4, wherein the one or more ferrite cores and the second ferrite core are evenly spaced from one another.

6. The system of claim 4, wherein the array of one or more ferrite cores includes the first ferrite core, the second ferrite core, and a third ferrite core, and wherein the first ferrite core and the second ferrite core are spaced at first distance, and the second ferrite core and the third ferrite core are spaced at a second distance, the first distance being different from the second distance.

7. The system of claim 4, wherein the one or more ferrite cores and the second ferrite core of the array comprise the same material.

8. The system of claim 4, wherein the first ferrite core comprises a first material, and the second ferrite core comprises a second material, the first material being different from the second material.

9. The system of claim 4, wherein the second ferrite core has low permeability and magnetic loss characteristics, the second ferrite core being disposed proximal to the feedline.

10. The system of claim 4, wherein each of the one or more ferrite cores has permeability and permittivity characteristics greater than unity.

11. The system of claim 4, wherein the first ferrite core is proximally disposed, to the radiator body, at a first position along the feedline, and the second ferrite core is distally disposed, to the radiator body, at a second position along the feedline.

12. The system of claim 4, wherein the first ferrite core is distally disposed, to the radiator body, at a first position along the feedline, and the second ferrite core is proximally disposed, to the radiator body, at a second position along the feedline.

13. The system of claim 4, wherein the second ferrite core comprises a single unitary structure selected from the group consisting of a pot core, a U-shaped core, an E-shaped core, and a combination thereof.

14. The system of claim 1, wherein the first ferrite core has permeability and permittivity characteristics greater than unity.

15. The system of claim 1, wherein the first ferrite core comprises spinel ferrite selected from the group consisting of a nickel-zinc (Ni—Zn) based ferrite composite, a manganese-zinc (Mn—Zn) based ferrite composite, a nickel-zinc-copper (Ni—Zn—Cu) based ferrite composite, a nickel-manganese-cobalt (Ni—Mn—Co) based ferrite composite, a cobalt (Co) based ferrite, lithium-zinc (Li—Zn) based ferrite composite, and a lithium-manganese (Li—Mn) based ferrite composite.

16. The system of claim 1, wherein the first ferrite core comprises hexagonal ferrite selected from the group consisting of an M-type hexaferrite, a Y-type hexaferrite, a Z-type hexaferrite, a W-type ferrite composite, an X-type hexaferrite, and U-type hexaferrite.

17. The system of claim 16, wherein the first ferrite core comprises hexagonal ferrite selected from the group consisting of $Ba_3Co_2Fe_{24}O_{41}$, $BaCo_{1.4}Zn_{0.6}Fe_{16}O_{27}$, and $Ba_2Co_2Fe_{12}O_{22}$.

18. The system of claim 1, wherein the first member of the first ferrite core is disposed at the dielectric substrate such that the first surface is in contact with the reflector ground plane; and wherein the first ferrite core includes a second member that is coupled to the second surface of the first member to form a continuous structure.

19. The system of claim 1, wherein the first ferrite core includes a second member that is coupled to the first surface of the first member to form a continuous structure.

20. The system of claim 1, wherein the second ferrite core comprises a first member and a second member, collectively, forming a continuous integrated structure, wherein the first member has a first cross-section profile selected from the group consisting of a U-shape profile, a planar profile, and an L-shape profile, and wherein the second member has a second cross-section profile corresponding to the first cross-section profile so as to form a planar toroid body therewith.

21. The system of claim 1, wherein the first ferrite core is embedded in the dielectric substrate.

22. The system of claim 1, wherein the first ferrite core has a first thickness, and the dielectric substrate has a second thickness, the first thickness being the same with the second thickness.

23. The system of claim 1, wherein the first ferrite core has a first thickness, and the dielectric substrate has a second thickness, the first thickness being different from the second thickness.

24. The system of claim 1, wherein the feedline of the patch antenna has a serpentine portion proximal to the first ferrite core.

25. An antenna apparatus comprising:

a dielectric substrate having, on a first side, a radiator body in connection with a feedline and, on a second side, a reflector ground plane; and one or more ferrite cores, including a first ferrite core, coupled to the dielectric substrate proximal to the feedline, wherein the first ferrite core completely encapsulates the feedline, wherein the first ferrite core comprises a first member having a first surface and a second surface, and wherein the first member is disposed at the dielectric substrate such that the first surface is in direct contact with the reflector ground plane or with a portion of the dielectric substrate.

26. A method comprising:

providing an electric circuit coupled to a first end of a feedline of a patch antenna, wherein the patch antenna has a dielectric substrate having, on a first side, a radiator body in connection with the feedline and, on a second side, a reflector ground plane, wherein the patch antenna has one or more ferrite cores, including a first ferrite core, coupled to the dielectric substrate proximal to the feedline at a respective distance from the radiator body, wherein the first ferrite core completely encapsulates the feedline, wherein the ferrite core comprises a first member having a first surface and a second surface, and wherein the first member is disposed at the dielectric substrate of the patch antenna such that the first surface is in direct contact with a reflector ground plane of the patch antenna or with a portion of the dielectric substrate;

and energizing the electric circuit to generate a radiofrequency (RF) electrical signal that flows through the feedline to the radiator body, wherein the RF electrical signal has one or more harmonic distortions, including those at a second and third harmonic frequencies, suppressed at the feedline by the one or more ferrite cores disposed at the feedline.

* * * * *